US006848136B2

(12) United States Patent
Sonobe

(10) Patent No.: US 6,848,136 B2
(45) Date of Patent: Feb. 1, 2005

(54) BEDDING

(76) Inventor: Teruo Sonobe, 2-9, Miyakubo 2-chome, Ichikawa-shi, Chiba-ken (JP)

( * ) Notice: Subject to any disclaimer, the term of this patent is extended or adjusted under 35 U.S.C. 154(b) by 0 days.

(21) Appl. No.: 10/425,865

(22) Filed: Apr. 30, 2003

(65) Prior Publication Data

US 2004/0098808 A1 May 27, 2004

(30) Foreign Application Priority Data

Nov. 21, 2002 (JP) ..... 2002-338504
Nov. 21, 2002 (JP) ..... 2002-338505

(51) Int. Cl.[7] ..... A47C 16/00
(52) U.S. Cl. ..... 5/655.9; 5/729; 5/953
(58) Field of Search ..... 5/655.9, 737, 729, 5/738, 740, 953, 653

(56) References Cited

U.S. PATENT DOCUMENTS 3,564,628 A * 2/1971 Oxford ..... 5/707
3,987,507 A * 10/1976 Hall ..... 5/653
4,161,045 A * 7/1979 Regan ..... 5/727
4,682,818 A * 7/1987 Morell ..... 5/653
4,706,313 A * 11/1987 Murphy ..... 5/737
4,753,480 A * 6/1988 Morell ..... 5/653
5,426,801 A * 6/1995 Klearman et al. ..... 5/653
6,018,832 A * 2/2000 Graebe ..... 5/740
6,092,249 A * 7/2000 Kamen et al. ..... 5/655.9
6,209,159 B1 * 4/2001 Murphy ..... 5/654
6,671,911 B1 * 1/2004 Hill et al. ..... 5/655.3

FOREIGN PATENT DOCUMENTS

EP 445539 * 9/1991 ..... 5/729
JP 3031011 8/1996

* cited by examiner

*Primary Examiner*—Jong-Suk (James) Lee
(74) *Attorney, Agent, or Firm*—Ronald P. Kananen; Rader, Fishman & Grauer, PLLC

(57) ABSTRACT

A bedding is designed so that a cushion body may not be in direct contact with affected part. The bedding includes a cushion body and a cover enclosing. The cushion body formed of an elastic material and defining at least one through hole for removably receiving therein at least one cushion member. The cover defines take out opening which can be opened and closed.

4 Claims, 24 Drawing Sheets

BEDDING

CROSS REFERENCE TO THE RELATED APPLICATION

The present application has been filed with claiming priority based on Japanese Patent Application Nos. 2002-338504 and 2002-338505, both filed on Nov. 21, 2002. Disclosure of the above-identified Japanese Patent Applications is herein incorporated by reference.

BACKGROUND OF THE INVENTION

1. Field of the Invention

The present invention relates to a bedding, such as futon mat (Japanese mattress), mattress, pillow, cushion and so forth.

2. Description of the Related Art

When a user does not change attitude on a bed or chair frequently enough, or a particular portion of the body may be depressed for a long period of time to cause ectrimma (so-called bed sore).

As one kind of bedding for preventing ectrimma, there has been known a doughnut form cushion having a central through hole formed by enclosing a cushion body in an annular shaped cover.

Such cushion has been known as capable of preventing the occurrence or deterioration of ectrimma by absorbing body pressure to be exerted on a particular portion of the body, particularly on the affected part by the cushion body. (see Japanese Utility Model Registration No. 3031011, particularly FIGS. 1 and 3).

However, even though the cushion may protect the affected area by a necessary cushioning effect of the cushion body, it is possible that the user may feel pain even by contacting the cushion body. In case of the doughnut shape cushion, unless it is used in a condition where the central through hole is aligned with the affected part, the cushion body inherently contacts the affected area to cause inconvenience.

On the other hand, in case of the futon mat or mattress which does not have the central through hole of the cushion, the cushion body inherently contacts the entire affected part to cause similar shortcoming.

Furthermore, even in the case of a pillow enclosing the necessary cushion body, and if tumefaction or the like is present in a head portion, it is inherent that the affected part is depressed.

SUMMARY OF THE INVENTION

The present invention has been worked out in order to solve the problem set forth above. It is therefore an object of the present invention to provide a bedding which is designed so that a cushion body may not be in direct contact with an affected part.

According to the first aspect of the present invention, a bedding comprises:

a cushion body; and a cover enclosing the cushion body therein, the cushion body formed of an elastic material and defining at least one through hole for removably receiving therein at least one cushion member, and the cover defines a take out opening which can be opened and closed.

According to the second aspect of the present invention, a bedding comprises:

a cushion body; and a cover enclosing the cushion body therein, the cushion body formed of an elastic material and including a thick quadrangular main body defining at least one through hole, and at least one cushion member removably received within the through hole, and the cover being formed by placing a substantially quadrangular shaped upper member having peripheral wall portion and a lower member of substantially quadrangular shape being the same as the upper member, in vertical alignment, by sewing the lower edge of the peripheral wall portion and an outer peripheral edge of the lower member along two edges adjacent across a substantially right angle corner, by providing on the other two edges, an openably closing fastener for forming a taking out opening which can be opened and closed in order to take in and out the cushion body, and providing at least one mounting strap on the outer peripheral edge of the lower member.

According to the third aspect of the present invention, a bedding comprises:

a cushion body; and a cover enclosing the cushion body therein, the cushion body formed of an elastic material and including a thick disc shaped main body defining at least one through hole and at least one cushion member removably received within the through hole, and the cover formed by placing a substantially circular upper member having a peripheral wall portion and a substantially circular lower member being the same as the upper member, placed in vertical alignment, by sewing the lower edge of the peripheral wall portion and an outer peripheral edge of the lower member in substantially half of circumferential length thereof, providing along another half of the circumferential length, an openably closing fastener for forming a taking out opening, and providing at least one mounting strap on the outer peripheral edge of the lower member.

According to the fourth aspect of the present invention, a bedding comprises:

a cushion body; and a cover enclosing the cushion body therein, the cushion body formed of an elastic material and including a main body defining a central hole and a plurality of through holes and a plurality of cushion members removably received within the through holes, and the cover formed by connecting a circular upper member formed with a center through hole and a circular lower member formed with a center through hole by a cylindrical member sewn with the inner peripheral edges of the upper and lower members, sewing an upper edge of an outer periphery member with an outer peripheral edge of the upper member, and providing an openably closing fastener over the enter circumferential length between the lower edge of the outer periphery member and the outer peripheral edge of the lower member to define a take out opening.

According to the fifth aspect of the present invention, a bedding comprises:

a cushion body; and a cover enclosing the cushion body therein, the cushion body formed of an elastic material and including a thick quadrangular main body defining at least one through hole and at least one cushion member removably received within the through hole, and the cover being a quadrangular bag form in plan view and defining a take out opening, a lid being secured on an edge portion for openably closing the take out opening.

According to the sixth aspect of the present invention, a bedding comprises:

a cushion body; and a cover enclosing the cushion body therein, the cushion body being formed from an elastic material and including a main body formed of an elastic material and formed into a laterally elongated frame form defining a single through hole in plan view and substantially elliptical shape as viewed from lateral side and at least one cushion member removably received within the through hole, and the cover being formed by placing a substantially quadrangular shaped upper member having peripheral wall portion and a lower member, of a substantially quadrangular shape the same as the upper member, in vertical alignment, by sewing the lower edge of the peripheral wall portion and an outer peripheral edge of the lower member along two edges adjacent across a substantially right angle corner, by providing on the other two edges, an openably closing fastener for forming a taking out opening which can be opened and closed in order to take in and out the cushion body.

According to the seventh aspect of the present invention, a bedding comprises:

a cushion body; and a cover enclosing the cushion body therein, the cushion body being formed from an elastic material and including a main body formed of an elastic material and formed into a laterally elongated frame form defining a single through hole in plan view and a substantially semi-elliptic shape as viewed from lateral side and at least one cushion member removably received within the through hole, and the cover being formed by placing a substantially quadrangular shaped upper member having a peripheral wall portion and a lower member of substantially quadrangular shape the same as the upper member, in vertical alignment, by sewing the lower edge of the peripheral wall portion and an outer peripheral edge of the lower member along two edges adjacent across a substantially right angle corner, by providing on the other two edges, an openably closing fastener for forming a taking out opening which can be opened and closed in order to take in and out the cushion body.

In the bedding of the first to seventh aspect of the present invention, cushion body may be formed from a laminated elastic material including an upper layer, an intermediate layer and a lower layer, and the intermediate layer has the highest hardness among the constituent layers.

In the bedding of the first to seventh aspect of the present invention, a cover may be formed from a stretchable material which is stretchable in an arbitrary direction.

In the bedding of the first to seventh aspect of the present invention, the bedding may further comprise a bottom liner formed by enclosing a thin elastic material between upper and lower surfaces of a flexible material and placed below the cushion body.

BRIEF DESCRIPTION OF THE DRAWINGS

The present invention will be understood more fully from the detailed description given hereinafter and from the accompanying drawings of the preferred embodiment of the present invention, which, however, should not be taken to be limitations of the invention, but are for explanation and understanding only.

In the drawings.

DESCRIPTION OF THE PREFERRED EMBODIMENT

Figure 1:
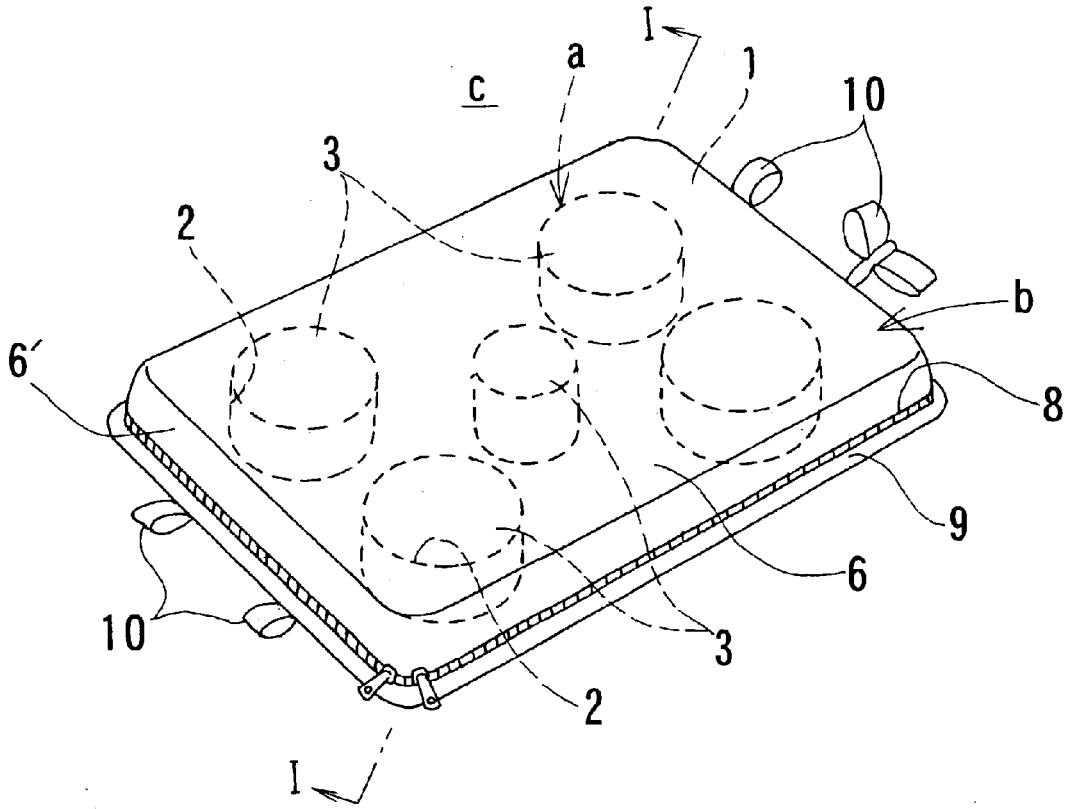
FIG. 1 is a perspective view of the first embodiment of an ectrimma preventive cushion according to the present invention.
Figure 2:
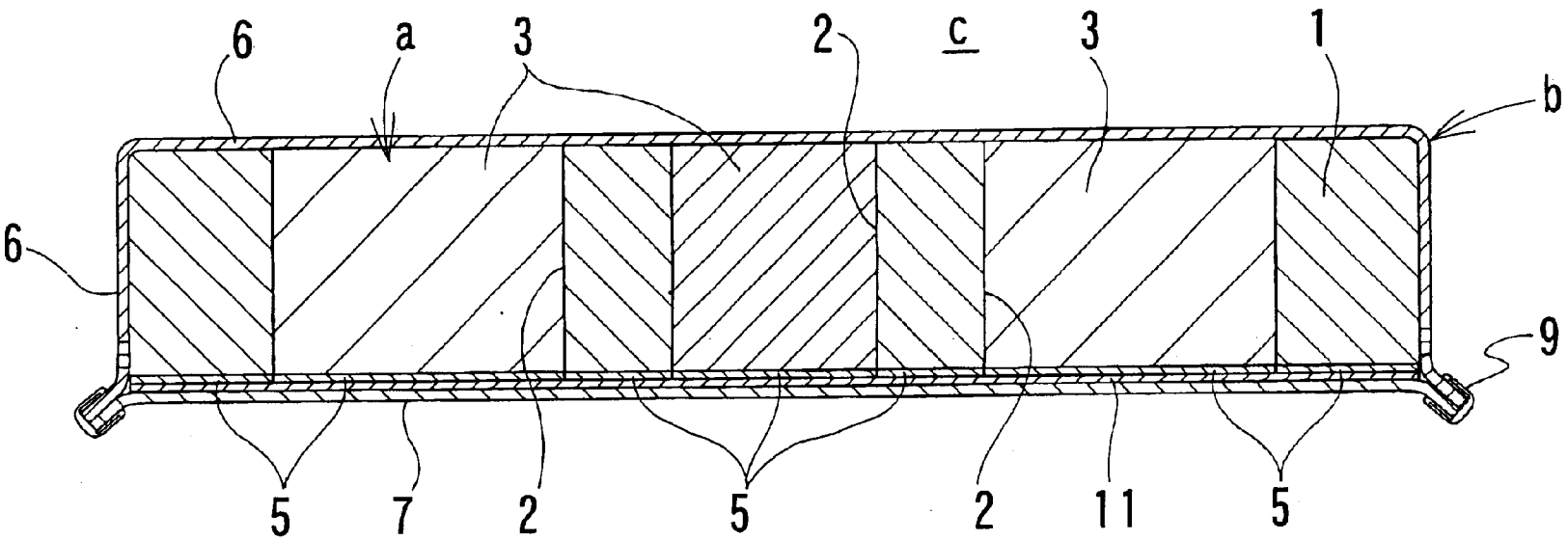
FIG. 2 is a sectional view taken along line I—I of FIG. 1.
Figure 3:
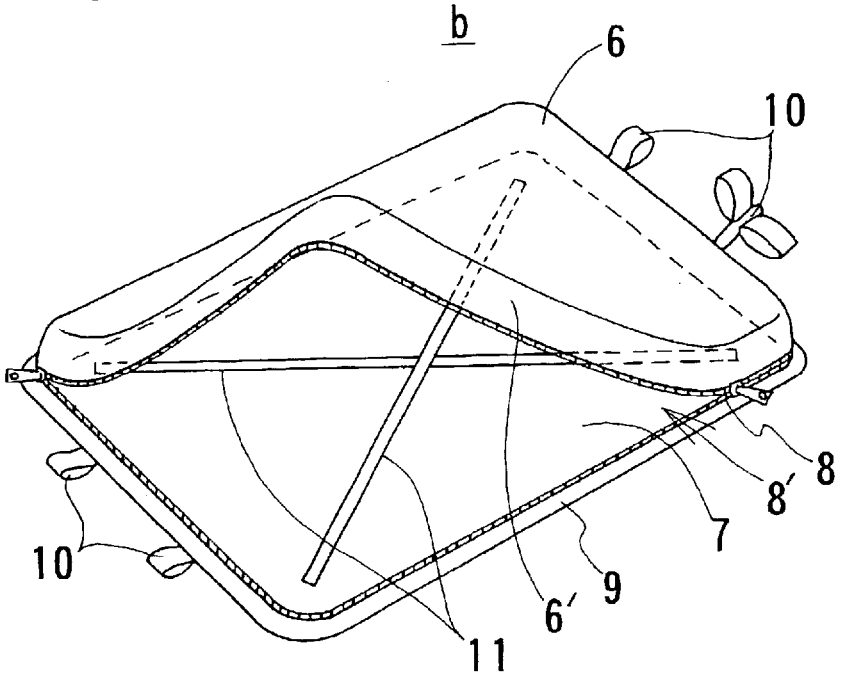
FIG. 3 is a perspective view of a cover in the first embodiment.
Figure 4:
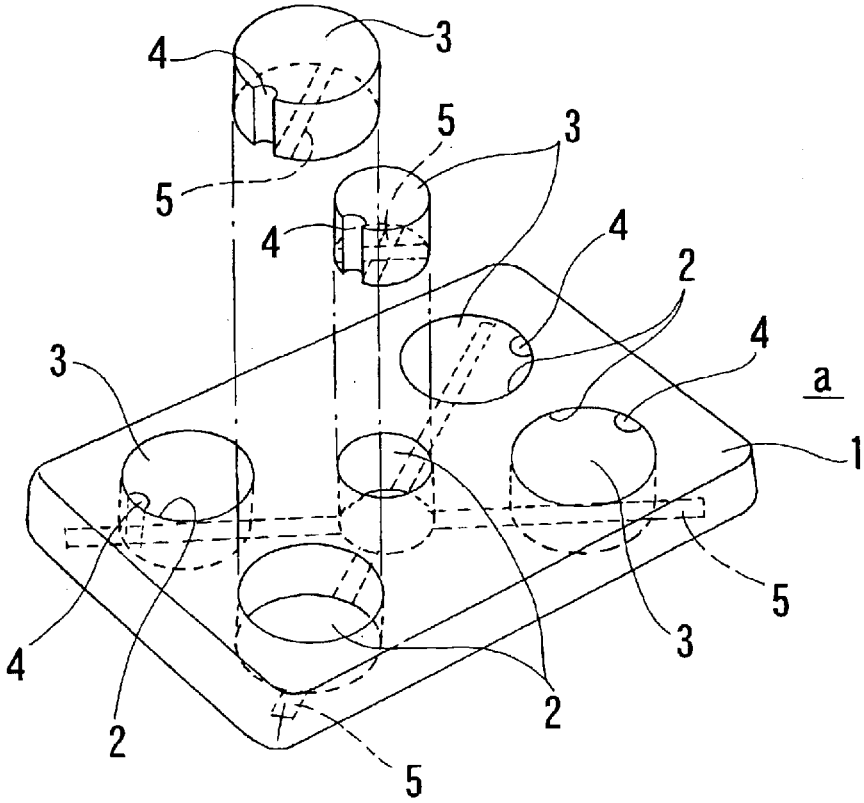
FIG. 4 is a perspective view of a cushion body in the first embodiment.
Figure 5:
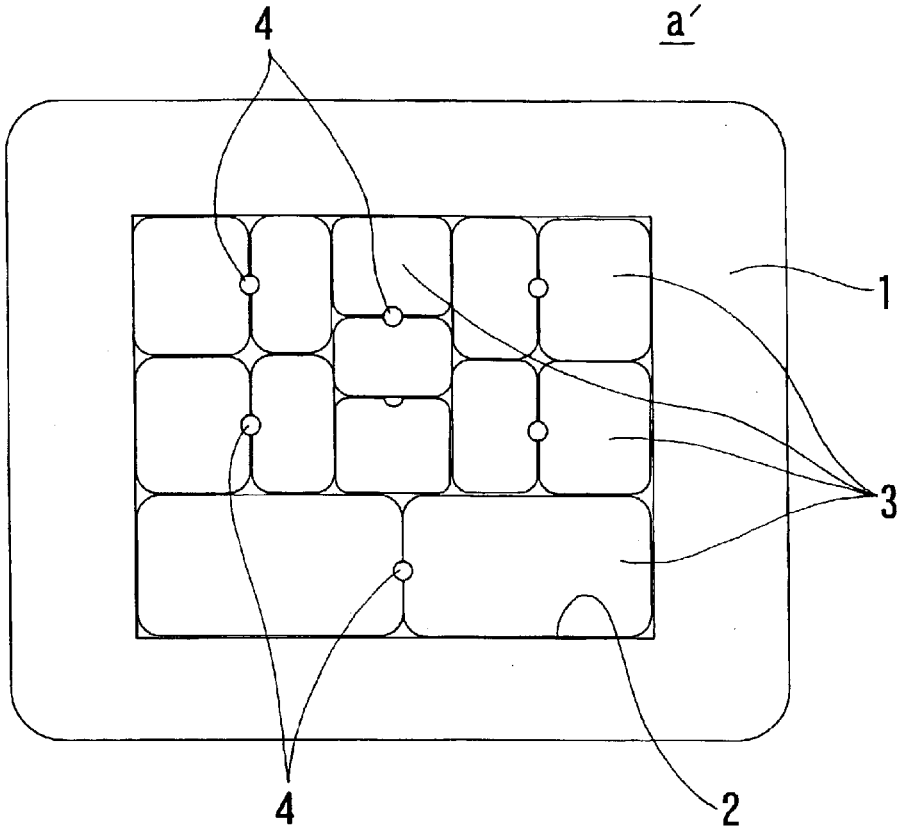
FIG. 5 is a plan view of another example of the cushion body.
Figure 6:
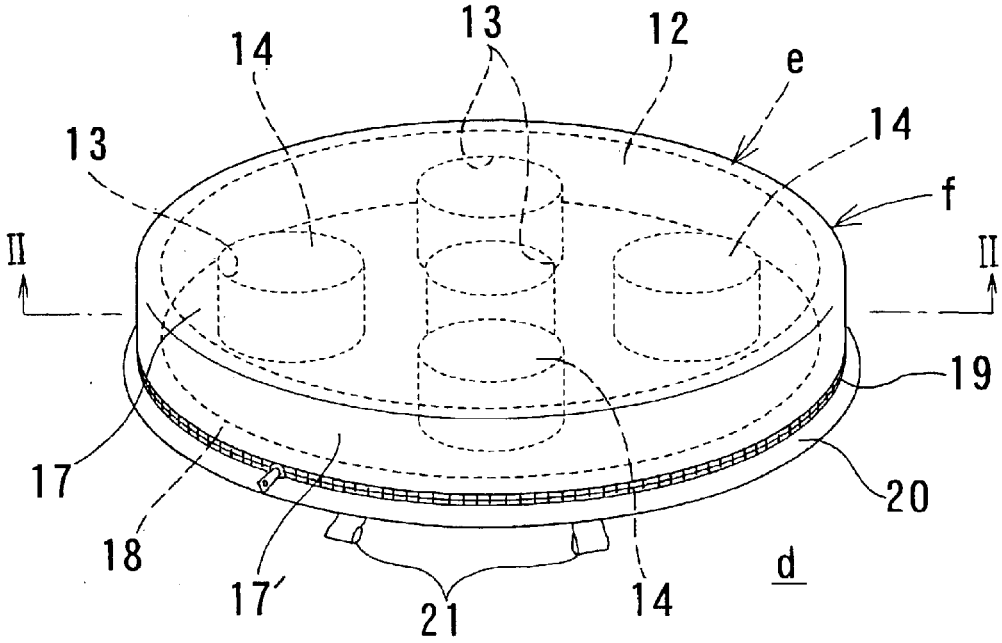
FIG. 6 is a perspective view of the second embodiment of an ectrimma preventive cushion according to the present invention.
Figure 7:
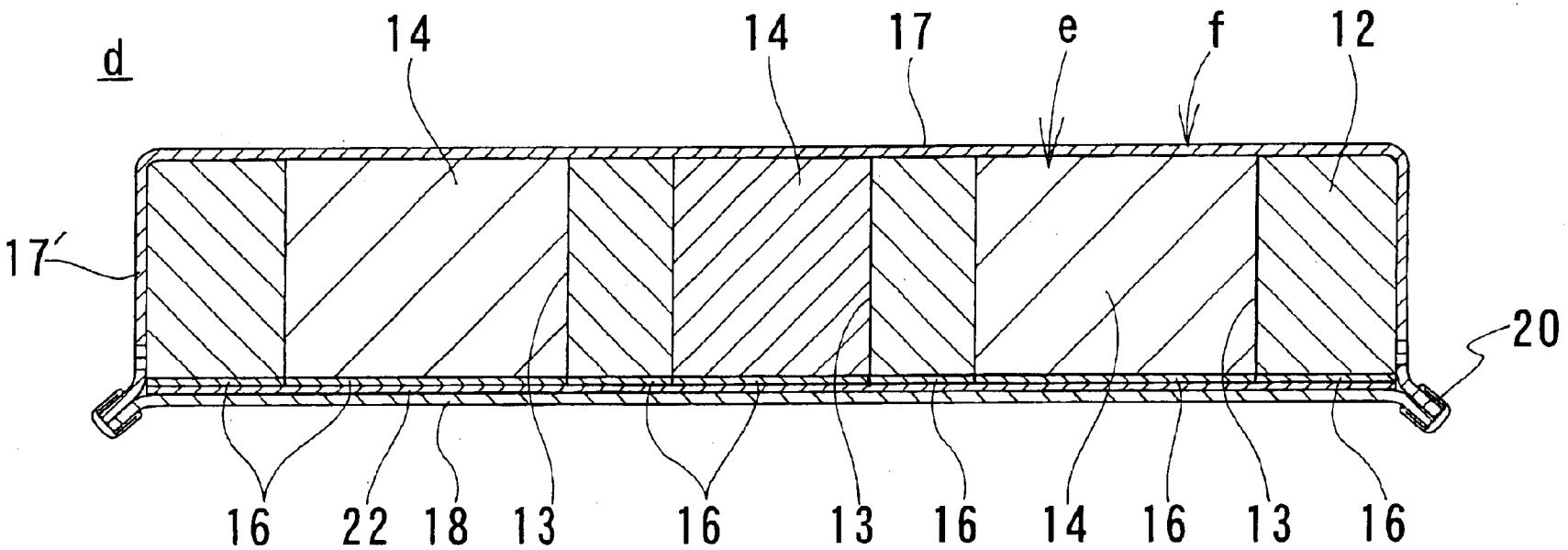
FIG. 7 is a sectional view taken along line II—II of FIG. 6.
Figure 8:
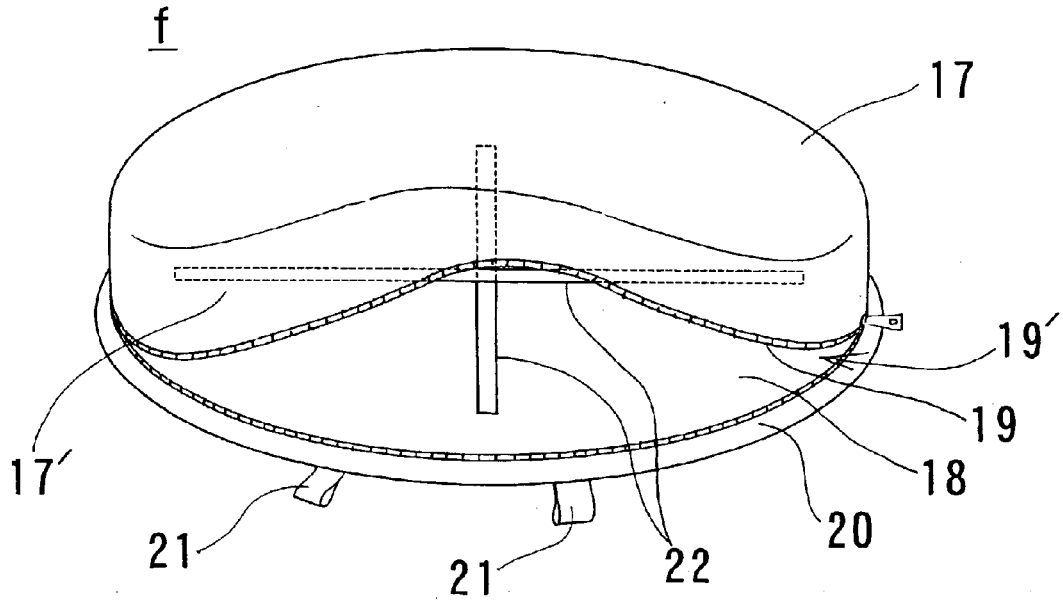
FIG. 8 is a perspective view of a cover in the second embodiment.
Figure 9:
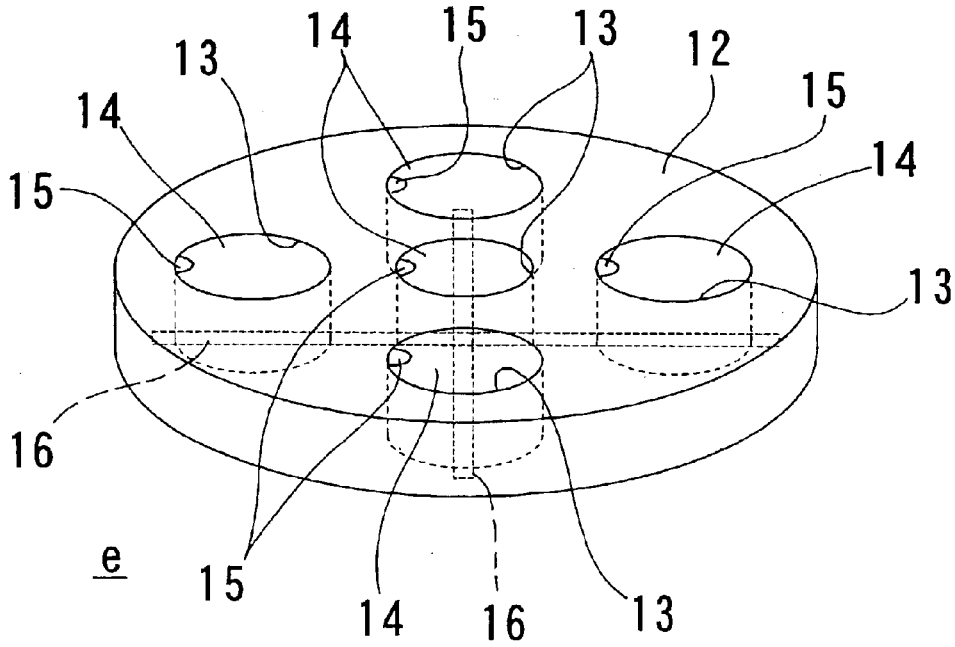
FIG. 9 is a perspective view of a cushion body in the second embodiment.
Figure 10:
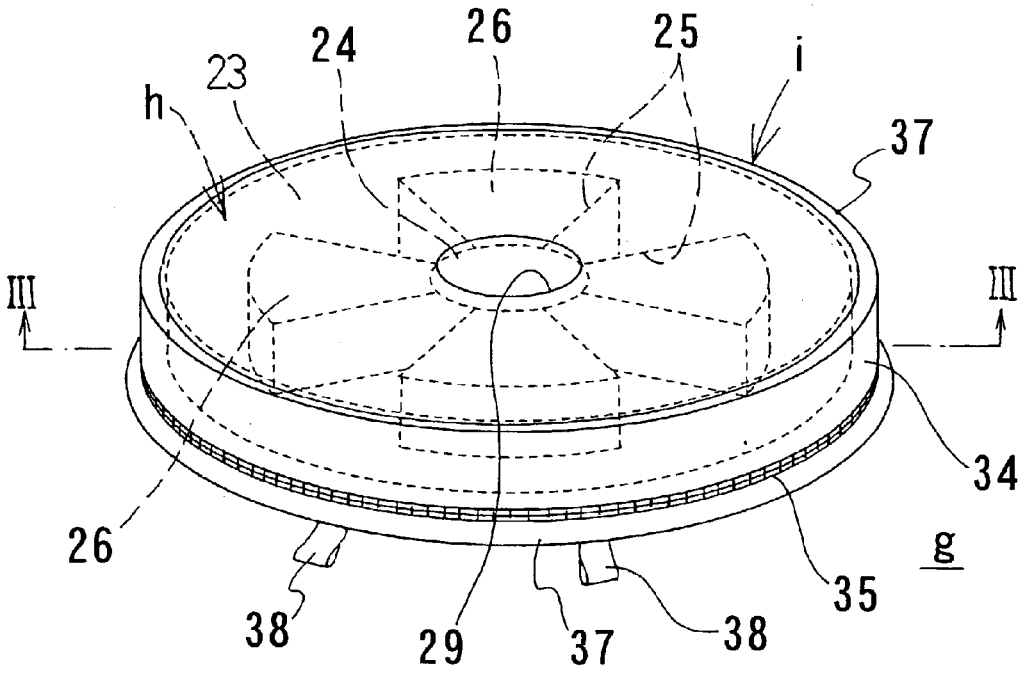
FIG. 10 is a perspective view of the third embodiment of an ectrimma preventive cushion according to the present invention.
Figure 11:
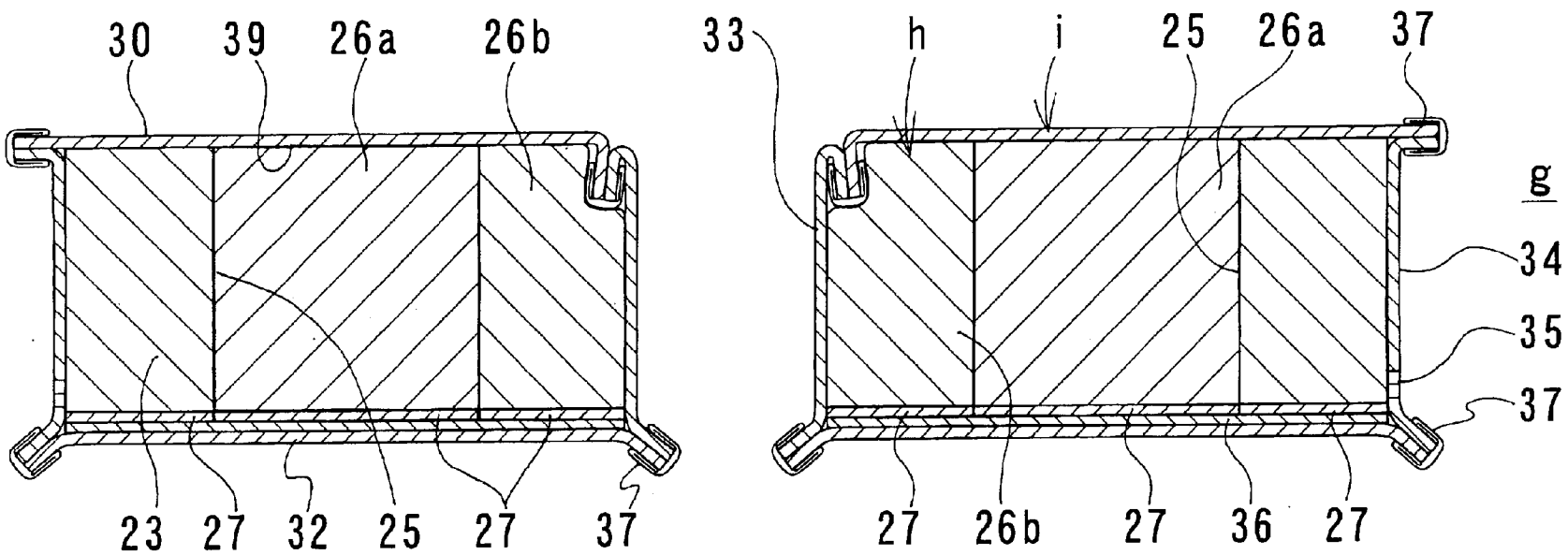
FIG. 11 is a sectional view taken along line III—III of FIG. 10.
Figure 12:
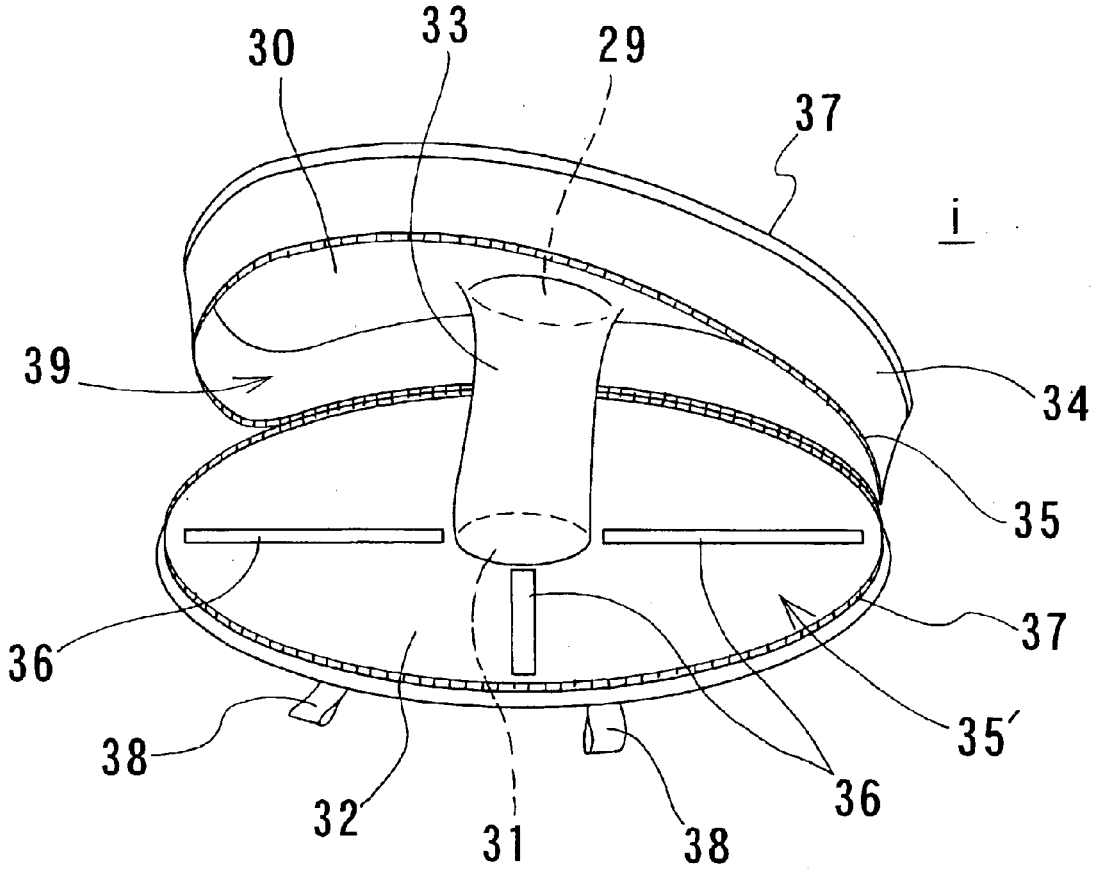
FIG. 12 is a perspective view of a cover in the third embodiment.
Figure 13:
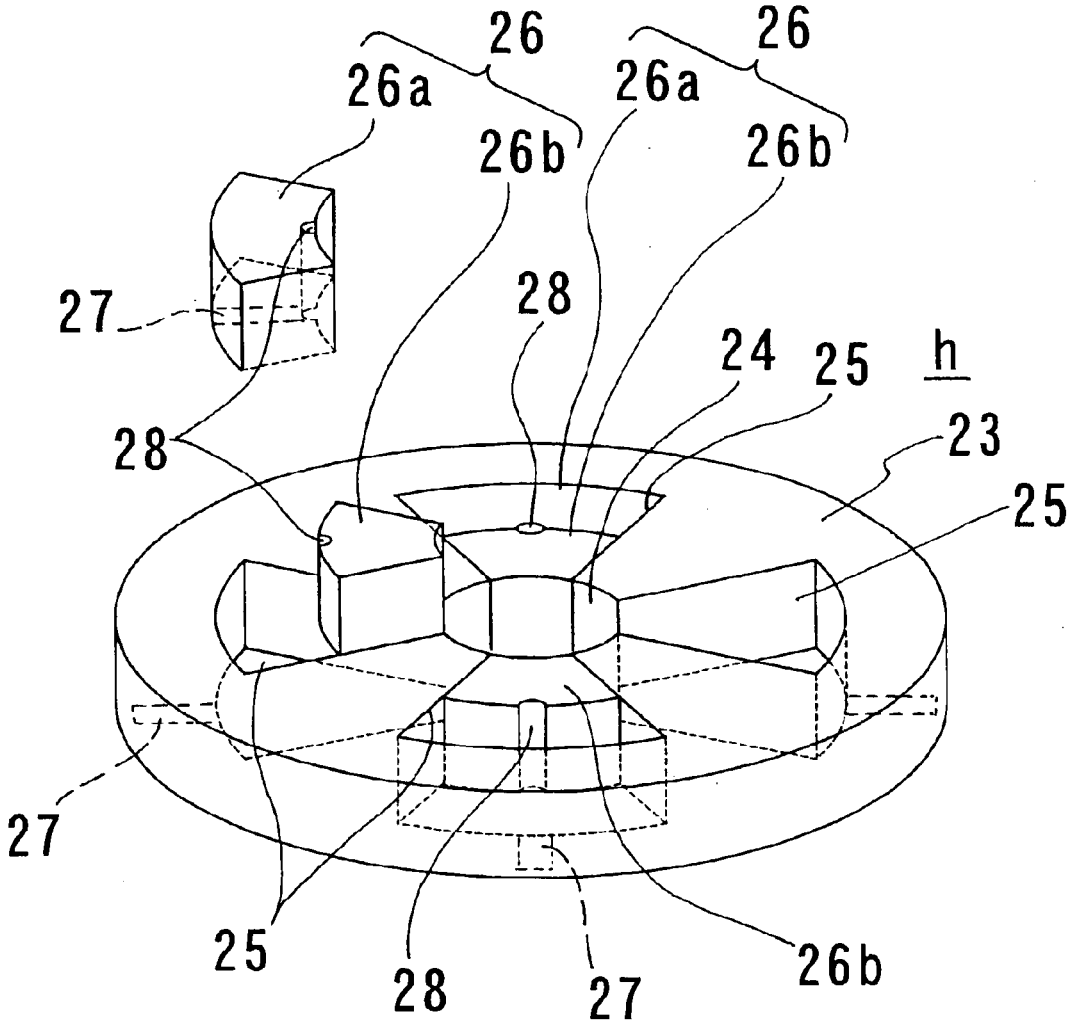
FIG. 13 is a perspective view of a cushion body in the third embodiment.
Figure 14:
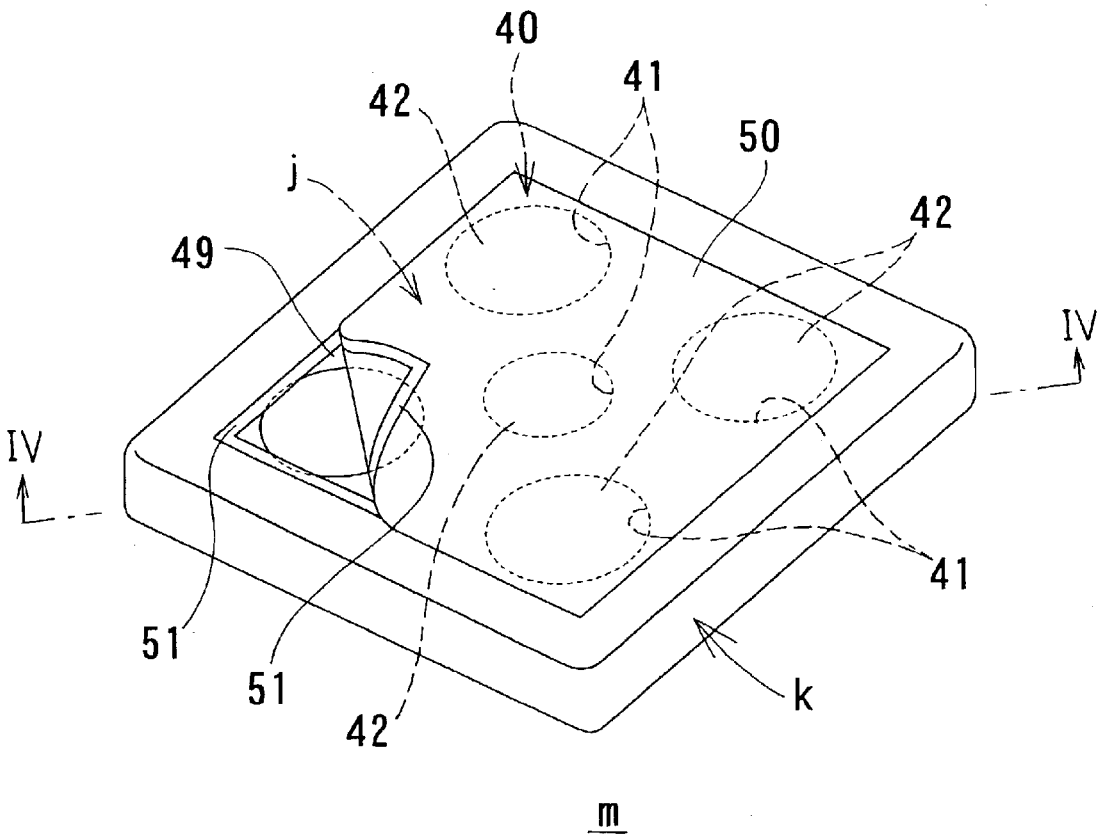
FIG. 14 is a perspective view of the fourth embodiment of an ectrimma preventive cushion according to the present invention.
Figure 15:
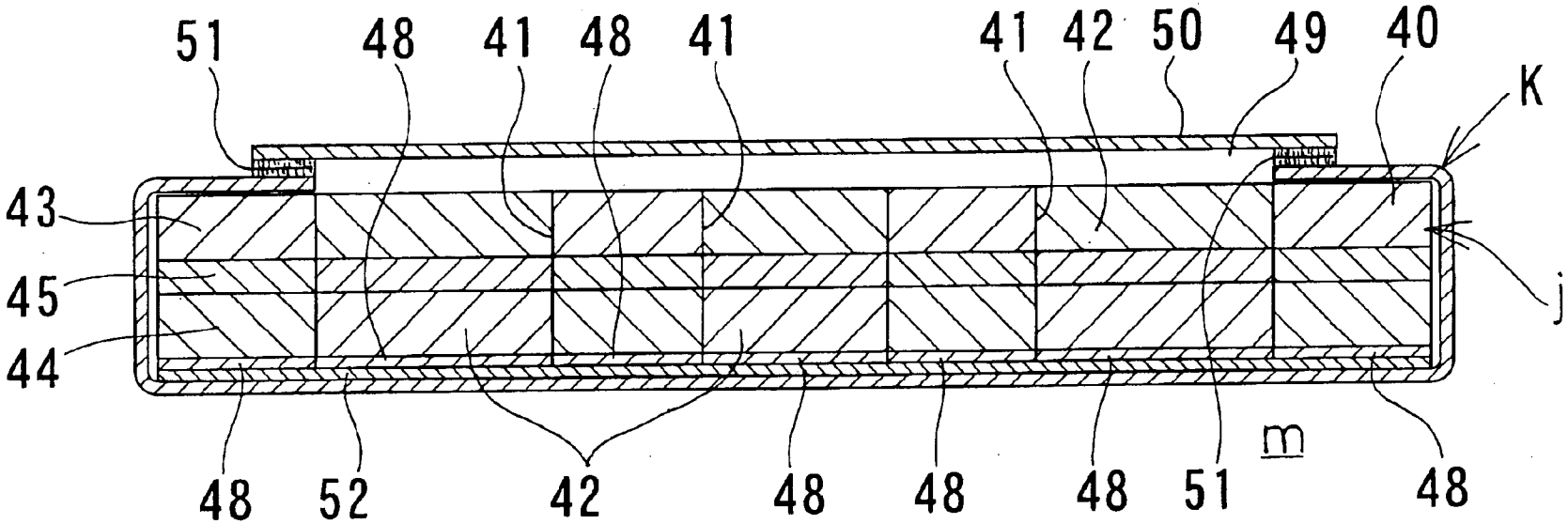
FIG. 15 is a sectional view taken along line IV—IV of FIG. 14.
Figure 16:
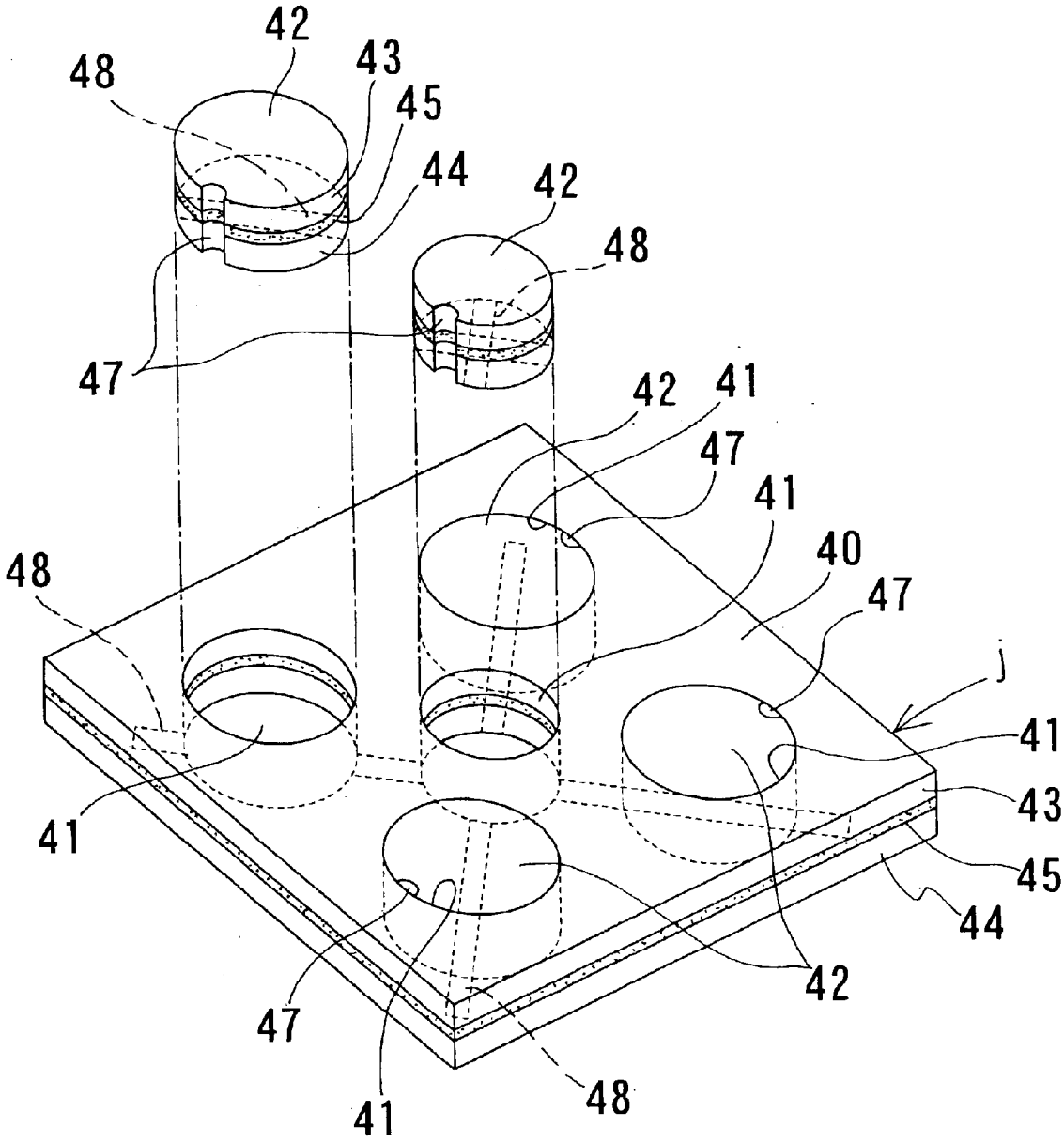
FIG. 16 is a perspective view of a cushion body in the fourth embodiment.

The present invention will be discussed hereinafter in detail in terms of the preferred embodiment of a bedding in accordance with the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessary obscurity of the present invention.

At first, an ectrimma preventive cushion being one kind of a bedding as a first embodiment will be discussed hereinafter in detail with reference to FIGS. 1 to 5.

The reference sign a denotes a cushion body formed by forming a plurality of through holes 2 extending through a main body 1 and opening in upper and lower surfaces of the main body 1, and removably inserting cushion members 3 respectively having complementary shape with respectively corresponding through holes 2.

The cushion members 3 are formed from an elastic material, such as sponge which is the same material as the main body 1. For instance, punched pieces obtained by punching for forming the through holes 2 may be used as the cushion members 3. On the side surface of each cushion member 3, a removal aiding groove 4 is cut away so as to facilitate taking out from the through hole 2 by hooking a finger therein.

On the lower surfaces of the main body 1 and respective cushion members 3, engaging side fastener straps 5 of Velcro fasteners (so-called Magic Tape: registered trademark) are fixed as fastening means, for example. In the shown embodiment, the engaging side fastener straps 5 on the main body 1 and respective cushion members 3 are so fixed as to be aligned with adjacent engaging side fastener straps forming an X-shape as a whole when the cushion members 3 are inserted into all of the through holes 2.

The number, size and shape of each through hole 2 and the cushion member 3 may be determined arbitrarily. For example, as the cushion body a' shown in FIG. 5, it is possible to insert a plurality of cushion members 3 of mutually different sizes and/or shapes may be inserted into a single large through hole 2.

The reference sign b denotes a cover formed of a flexible material, such as cloth, leather or the line, and more preferably stretchable material which is stretchable in an arbitrary direction. The shown embodiment of ectrimma preventive cushion c is formed by receiving the cushion body a in the cover b.

The cover b is formed by placing a substantially quadrangular shaped upper member 6 having peripheral wall portion 6' and a lower member 7 of substantially quadrangular shape the same as the upper member 6, in vertical alignment, and by sewing the lower edge of the peripheral wall portion 6' and an outer peripheral edge of the lower member 7 along two edges adjacent across a substantially right angle corner. Along the other two edges, a zipper 8 is fixed as an openably closing fastener for forming a taking out opening 8' which can be opened and closed in order to take in and out the cushion body a.

The outer peripheral edge of the lower member 7 is covered with a trim member 9 turning back at an arbitrary width. The trim member 9 is fitted over the outer peripheral edge of the lower member 7 and sewn thereon. On the two edges on opposite sides, respective two loop form mounting straps 10 are fitted.

The ectrimma preventive cushion c may be tied on a chair or the like by passing other cord or like through the mounting straps 10.

It should be noted that position and number of the mounting straps 10 may be arbitrarily modified. For example, it is possible to provide a necessary number of mounting straps 10 on each of the four corners of the lower member 7.

On an upper surface of the lower member 7, receiving side fastener straps 11 of the Velcro fastener forming pairs with the engaging side fastener straps 5 provided on the lower surfaces of the main body 1 of the cushion body a and respective cushion members 3, are fixed. The receiving side fastener straps 11 are arranged in an X-shaped pattern corresponding to the X-shaped pattern of the engaging side fastener straps 5 on the main body 1 and the cushion members 3.

Setting of the cushion body a in the cover b is performed by engaging the engaging side fastener straps 5 of the cushion body a with the receiving side fastener straps 11 on the cover b and then covering the cushion body with the upper member 6 and the lower member 7 of the cover, and then closing the zipper 8 for fastening the upper member 6 and the lower member 7 to enclose the cushion body a therein.

The ectrimma preventive cushion constructed as set forth above is normally used as a mat or a seat cushion or the like upon lying or sitting on a floor, bed or various chairs in the condition where the cushion body a assembled all cushion members 3 is enclosed in the cover b. The feature of the shown embodiment of the ectrimma preventing cushion is the capability of selective removal of one or more cushion member 3 located at a position or positions mating with the affected part of the user's body to make the through hole 2 hollow.

On the other hand, by forming the upper member 6 of the cover from stretchable material, the upper member 6 will not be tensed at the portion corresponding the hollow of the through hole 2 to penetrate into the hollow of the through hole 2 so as not to excessively depress the affected part.

Next, the second embodiment of the ectrimma preventive cushion according to the present invention as one kind of bedding will be discussed with reference to FIGS. 6 to 9.

The shown embodiment of the ectrimma preventive cushion d is differentiated from the first embodiment of the ectrimma preventive cushion c in that the shape of the cushion is a circular disc shaped configuration.

The reference sign e denotes a cushion body formed by forming a plurality of cross-sectional circular through holes 13 through a thick circular disc shaped main body 12 formed of an elastic material, such as sponge or the like, and removably inserting cushion members 14 of complementary shapes with the corresponding circular through holes 13 thereinto.

The cushion members 14 are formed from an elastic material, such as sponge which is the same material as the main body 12. For instance, punched pieces obtained by punching for forming the circular through holes 13 may be used as the cushion members 14. On the side surface of each cushion member 14, a removal aiding groove 15 is cut away so as to facilitate taking out from the circular through hole 13 by hooking a finger therein.

On the lower surfaces of the main body 12 and respective cushion members 14, engaging side fastener straps 16 of Velcro fasteners are fixed as fastening means, for example. In the shown embodiment, the engaging side fastener straps 16 on the main body 12 and respective cushion members 14 are so fixed as to be aligned with adjacent engaging side fastener straps forming a cross-shape as a whole when the cushion members 14 are inserted into all through holes 13.

The number, size and shape of each through hole 2 and the cushion member 14 may be determined arbitrarily.

The reference sign f denotes a cover formed of a flexible material, such as cloth, leather or the like, and more preferably stretchable material which is stretchable in an arbitrary direction. The shown embodiment of ectrimma preventive cushion d is formed by receiving the cushion body e in the cover f.

The cover f is formed by placing a substantially circular upper member 17 having a peripheral wall portion 17' and a substantially circular lower member 18 being the same as the upper member 17, placed in vertical alignment, and by sewing the lower edge of the peripheral wall portion 17' and an outer peripheral edge of the lower member 18 in substantially half of the circumferential length thereof. Along another half of the circumferential length, a zipper 19 is fixed as an openably closing fastener for forming a taking out opening 19' which can be opened and closed in order to take in and out the cushion body e.

The outer peripheral edge of the lower member 18 is covered with a trim member 20 turning back at an arbitrary width. The trim member 20 is fitted over the outer peripheral edge of the lower member 18 and sewn thereon. On the appropriate positions on the peripheral edge of the lower member 18, a required number of loops forming mounting straps 21 are fitted.

On an upper surface of the lower member 18, receiving side fastener straps 22 of the Velcro fastener forming pairs with the engaging side fastener straps 16 provided on the lower surfaces of the main body 12 of the cushion body e and respective cushion members 14, are fixed. The receiving side fastener straps 22 are arranged in cross-shaped pattern corresponding to the cross-shaped pattern of the engaging side fastener straps 16 on the main body 12 and the cushion members 14.

Setting of the cushion body e in the cover f is performed by engaging the engaging side fastener straps 16 of the cushion body e with the receiving side fastener straps 22 on the cover f and then covering the cushion body with the upper member 17 and the lower member 18 of the cover f, and then closing the zipper 19 for fastening the upper member 17 and the lower member 18 to enclose the cushion body e therein.

Next, the third embodiment of the ectrimma preventive cushion according to the present invention as one kind of bedding will be discussed with reference to FIGS. 10 to 13.

The shown embodiment of the ectrimma preventive cushion g is differentiated from the second embodiment of the ectrimma preventive cushion d in that the shape of the cushion is doughnut shaped configuration formed with through hole at the center thereof.

The reference sign h denotes a thick doughnut shape cushion body formed by forming a circular center through hole 24 through a thick circular disc shaped main body 23 formed of elastic material, such as sponge or the like. Four sectorial through holes 25 are formed with 90° of angular interval in circumferential direction.

These center through hole 24 and the sectorial through holes 25 are extended across entire thickness of the main body 23. In each sectorial through hole 25, a cushion member 26 of complementary shape with the corresponding sectorial through hole 25 is removably inserted.

In each sectorial through hole 25, it may be possible to insert a single cushion member 26. In the shown embodiment, it is also possible to insert two cushion members, i.e. an outer cushion member **26*a* complementary with outer half of the sectorial through hole 25 and an inner cushion member 26*b*** complementary with inner half of the sectorial through hole.

These cushion members 26 are formed from an elastic material, such as sponge which is the same material as the main body 23. For instance, the punched pieces obtained by punching for forming the sectorial through holes 25 may be used as the cushion members 26.

On the lower surfaces of the main body 23 and respective cushion members **26*a* and 26*b*, engaging side fastener straps 27 of Velcro fasteners are fixed as fastening means, for example. In the shown embodiment, the engaging side fastener straps 27 on the main body 23 and respective cushion members 26*a* and 26*b* are so fixed as to be aligned with adjacent engaging side fastener straps form cross-shape as a whole when the cushion members 26*a* and 26*b* are inserted into all sectorial through holes 25**.

On the other hand, on the side surface of each cushion member 26, a removal aiding groove 28 is cut away so as to facilitate taking out from the sectorial through hole 25 by hooking a finger therein.

The number, size and shape of each through hole 25 and the cushion member 26 may be determined arbitrarily.

The reference sign i denotes a cover removably receiving the cushion body. The cover i is formed by connecting a circular upper member 30 formed with a center through hole 29 and a circular lower member 32 formed with a center through hole 31 by a cylindrical member 33 sewn with the inner peripheral edges of the upper and lower members 30 and 32, sewing an upper edge of an outer periphery member 34 with an outer peripheral edge of the upper member 30, and providing a zipper 35 over the enter circumferential length between the lower edge of the outer periphery member 34 and the outer peripheral edge of the lower member 32 to define a take out opening 35' which can be opened and closed.

The upper member 30, the lower member 32, the cylindrical member 33 and the outer periphery member 34 are formed from flexible material, such as cloth, leather or the like, and preferably from a stretchable material which can be stretched in any arbitrary direction.

On an upper surface of the lower member 32, receiving side fastener straps 36 of the Velcro fastener forming pairs with the engaging side fastener straps 27 provided on the lower surfaces of the main body 23 of the cushion body and respective cushion members 26, are fixed. The receiving side fastener straps 36 are arranged in a cross-shaped pattern corresponding to the cross-shaped pattern of the engaging side fastener straps 27 on the main body 23 and the cushion members 26.

The outer peripheral member 34 and the upper member 30, the upper member 30 and the cylindrical member 33, and the cylindrical member 33 and the lower member 32 are respectively overlapped in given widths and fitted over trim members 37 turning back at an arbitrary width, and sewn together. On the other hand, on the outer peripheral edge of the lower member 32, the trim member 37 is fitted over and sewn. Also, a required number of mounting straps 38 are fixed at arbitrary positions on the outer peripheral edge of the lower member 32.

The cover i is in a condition where the center through holes 29 and 31 of the upper and lower members 30 and 32 are connected through the cylindrical member 33. On the outer side of the cylindrical body 33, a cushion receptacle portion 39 is defined by the upper member 30, the lower member 32 and the outer periphery member 34.

Setting of the cushion body h in the cover i is performed by engaging the engaging side fastener straps 27 of the cushion body h with the receiving side fastener straps 36 on the cover i and then covering the lower surface of the cushion body with the lower member, and the upper surface and the outer peripheral surface of the cushion body with the upper member 30 and the outer periphery member 34, and then closing the zipper 35 for fastening between the lower member 32 and the outer periphery member 34.

Next, the fourth embodiment of the ectrimma preventive cushion according to the present invention will be discussed as one kind of the bedding with reference to FIGS. 14 to 17.

The reference sign j denotes a cushion body formed by forming a plurality of cross-sectional circular through holes 41 through a thick quadrangular main body 40 from a laminated elastic material laminating elastic materials, such as sponge, and by removably inserting cushion members 42 of complementary shape with respectively corresponding circular through holes 41.

The laminated elastic material is formed by laminating three plate form elastic members having mutually different hardnesses and bonding them for integration. In the laminated elastic material, among three layers, an upper layer 43 has smaller hardness than that of a lower layer 44, and an intermediate layer 45 has hardness greater than that of the lower layer 44.

As set forth above, since the elastic materials having different hardnesses are laminated, in response to relatively small depression force which does not cause deformation of the lower layer 44 and the intermediate layer 45, only upper layer 43 may be deformed for achieving cushioning function. On the other hand, when the depression force exerted is large enough to cause deformation of all layers of the elastic material, the intermediate layer 45 may cause deformation for achieving the cushioning function.

The laminated elastic material may be prepared with a desired hardness by adjusting the hardness and thicknesses of respective layers 43, 44 and 45.

It should be noted that the upper and lower layers 43 and 44 are merely required to have a smaller hardness than that of the intermediate layer 45. Therefore, it is possible to provide the same hardness for the upper and lower layers 43 and 44.

Figure 17A:
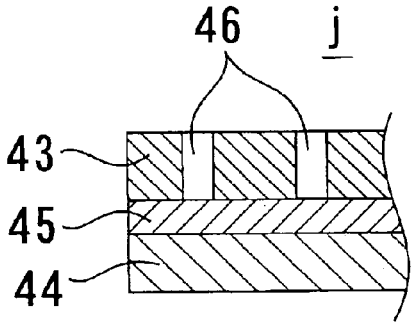
FIGS. 17A and 17B are partial enlarged section showing modifications of the cushion bodies.
Figure 17B:
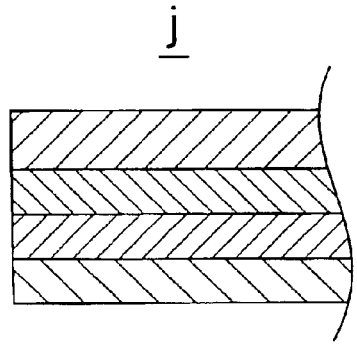

Furthermore, as shown in FIG. 17A, by forming large number of fine conduits 46 in any desired layer, flexibility can be increased. Also, as shown in FIG. 17B, the elastic material may be formed with four layers, for example.

The cushion members 42 may be formed from the same material as the main body 40. For instance, punched pieces obtained by punching for forming the circular through holes 41 may be used as the cushion members 42. On the side surface of each cushion member 42, a removal aiding groove 47 is cut away so as to facilitate taking out from the circular through hole 41 by hooking a finger therein.

The number, size and shape of each through hole 41 and the cushion member 42 may be determined arbitrarily.

On the lower surfaces of the main body 40 and respective cushion members 42, engaging side fastener straps 48 of Velcro fasteners are fixed as fastening means, for example. In the shown embodiment, the engaging side fastener straps 48 on the main body 40 and respective cushion members 42 are so fixed as to be aligned with adjacent engaging side fastener straps forming an X-shape as a whole when the cushion members 42 are inserted into all through holes 41.

The reference sign k denotes a cover formed of a flexible material, such as cloth, leather or the line, and more preferably stretchable material which is stretchable in an arbitrary direction. The shown embodiment of the ectrimma preventive cushion m is formed by receiving the cushion body j in the cover k.

The cover k is formed into a bag form of a quadrangular shape in plan view and having a size for receiving the cushion body j. In a central portion of the upper surface of the cover k, a quadrangular shape take out opening 49 is formed in order to taking in and out the cushion body j.

The reference numeral 50 is a quadrangular lid member fitted to the cover by sewing on one edge portion of the take out opening 49. The remaining three edges of the lid member 50 can be fastened by Velcro fastener 51 that include a pair of fastener straps fixed on the corresponding edge portions of the lid member 50 and the edge portions of the take out opening 49. Thus, the take out opening 49 can be opened and closed by the lid member 50.

It is also possible to provide Velcro fastener even along the edge which is sewn and to secure Velcro fastener over the entire periphery of the cover k.

In the cover k, the receiving side fastener straps 52 of the Velcro fastener forming a pair with the engaging side fastener straps 48 fixed on the lower surfaces of the main body 40 of the cushion body j and the cushion members 42, are fixed in an X-shape pattern corresponding to the X-shape pattern of the engaging side fastener straps 48.

Setting of the cushion body j in the cover k is performed by engaging the engaging side fastener straps 48 of the cushion body j with the receiving side fastener straps 52 on the cover k and then covering the bottom surface, side surface and outer peripheral portion of the upper surface of the cushion body with the cover k and covering the center portion of the upper surface of the cushion body with the lid member 50.

Figure 18:
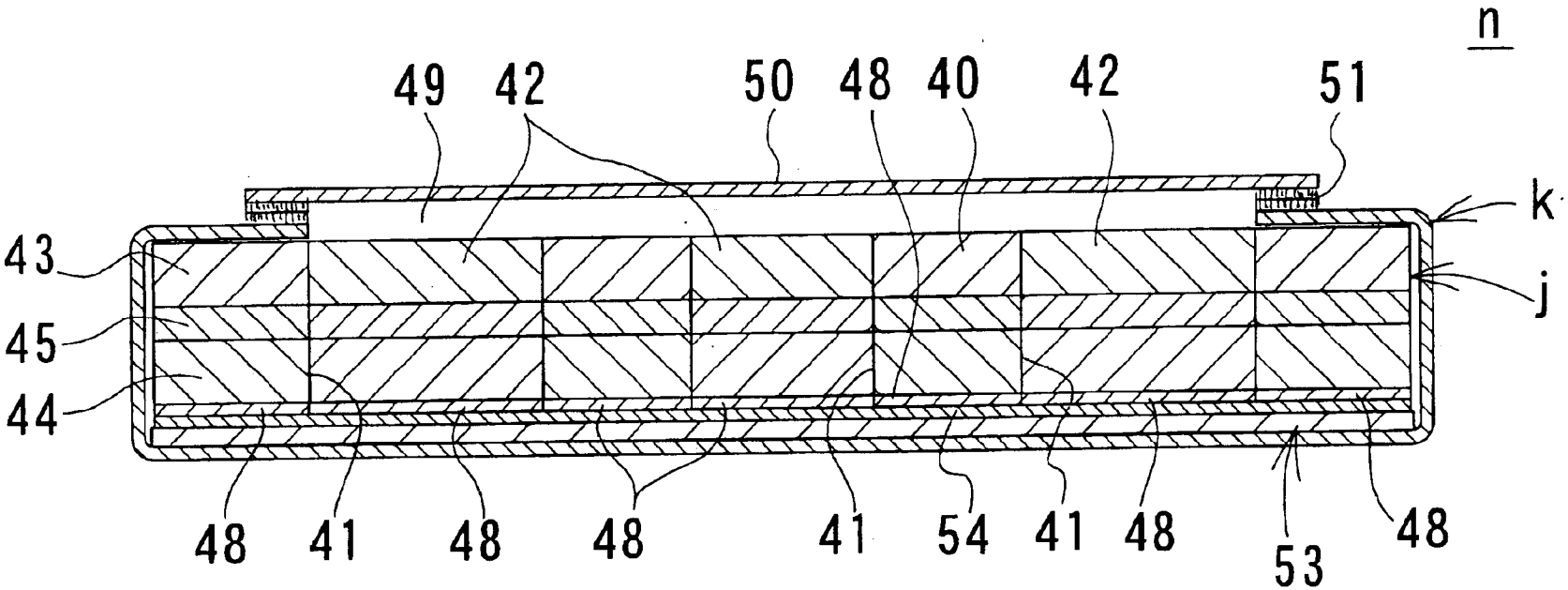
FIG. 18 is a longitudinal section of the fifth embodiment of an ectrimma preventive cushion according to the present invention.
Figure 19:
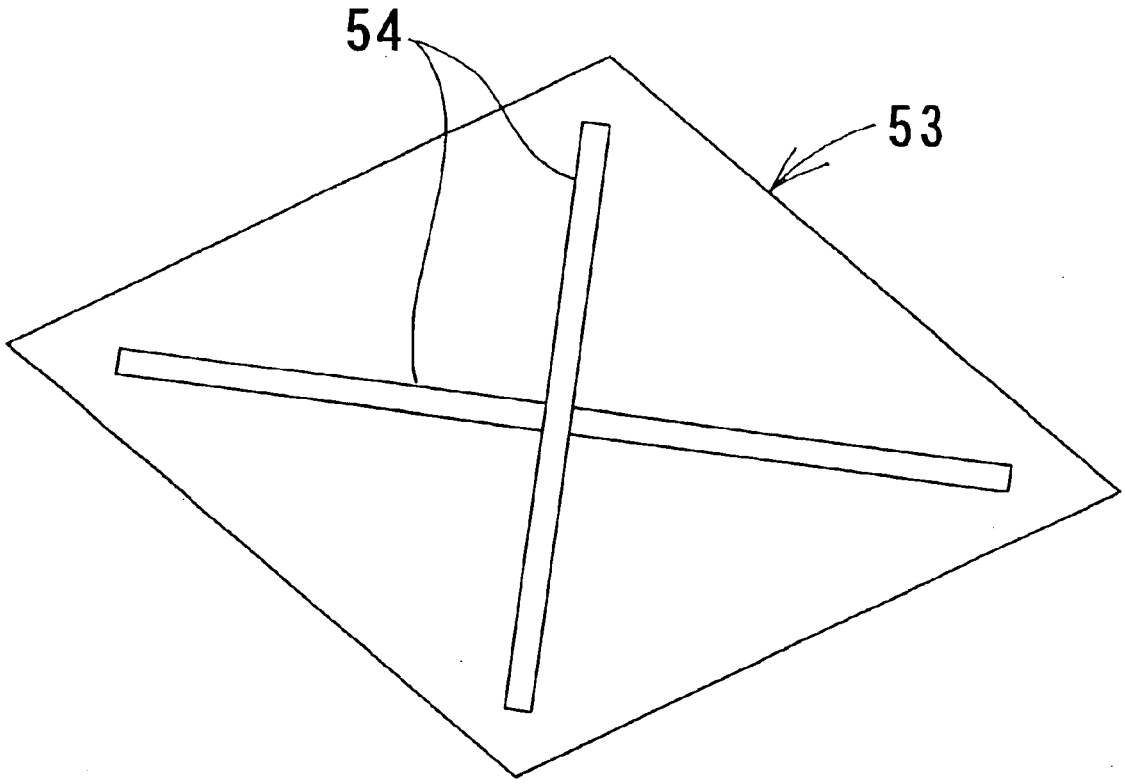
FIG. 19 is a perspective view of a bottom liner in the fifth embodiment.
Figure 20:
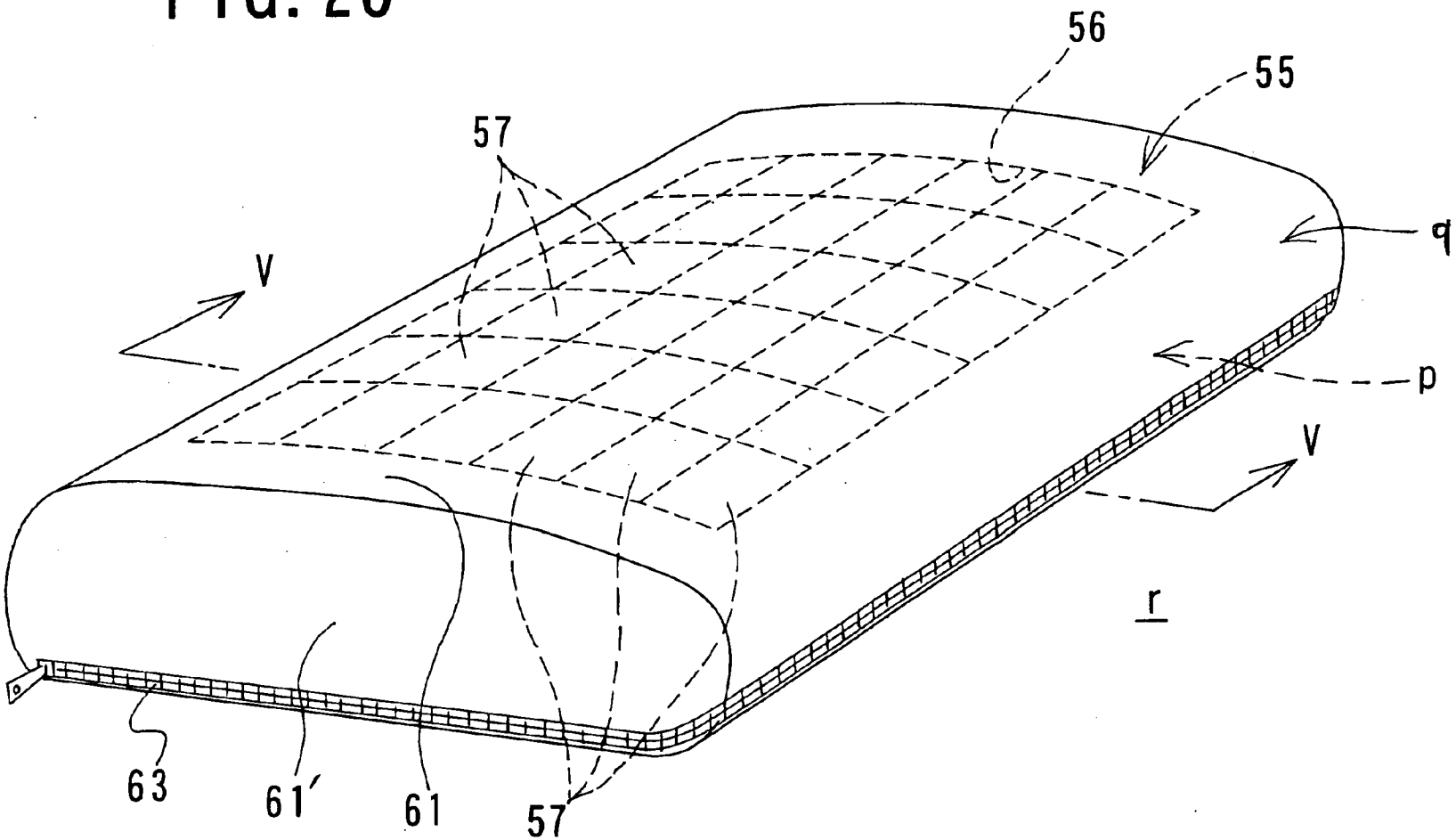
FIG. 20 is a perspective view of the sixth embodiment of an ectrimma preventive cushion according to the present invention.
Figure 21:
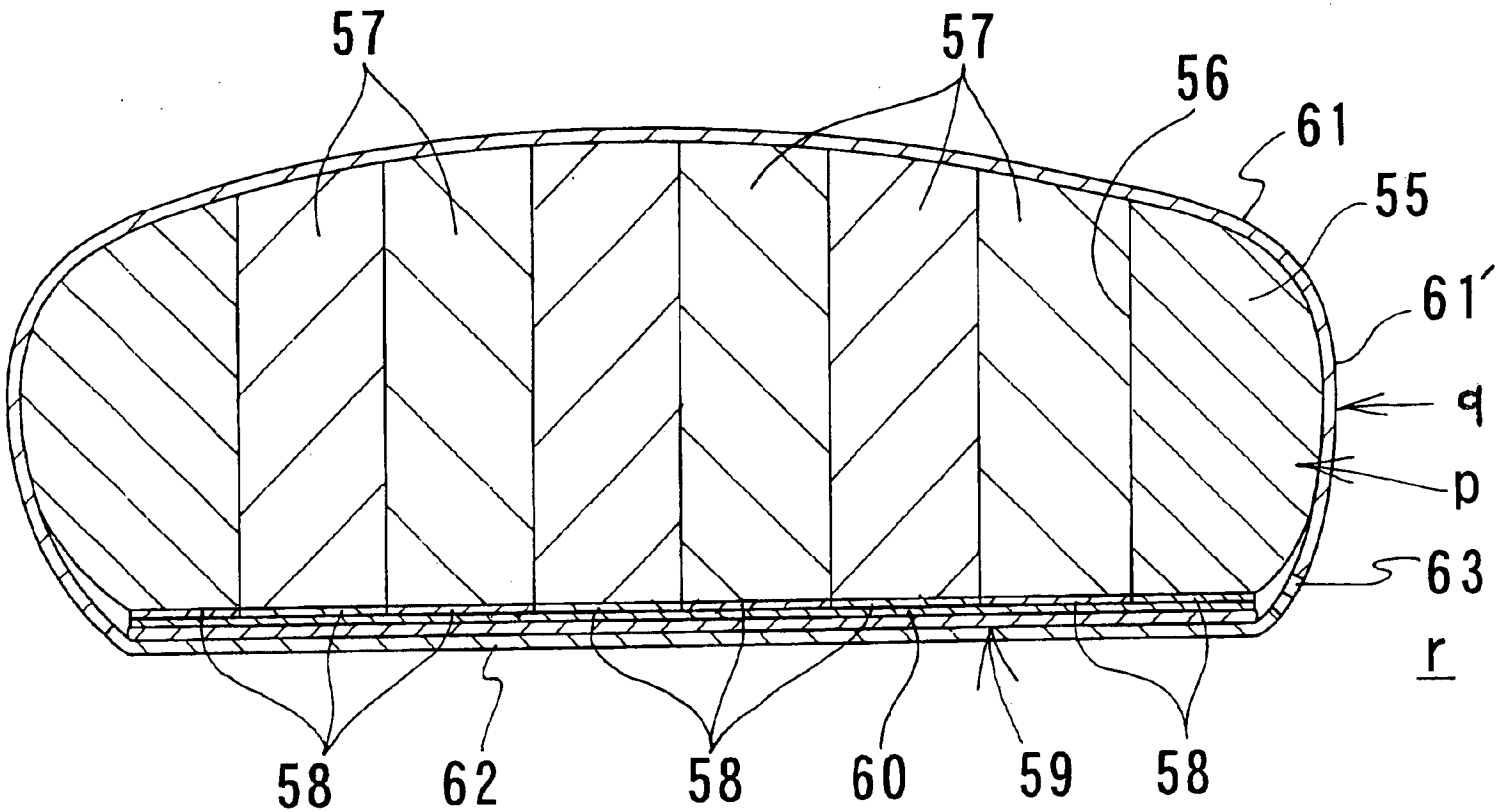
FIG. 21 is a sectional view taken along line V—V of FIG. 20.
Figure 22:
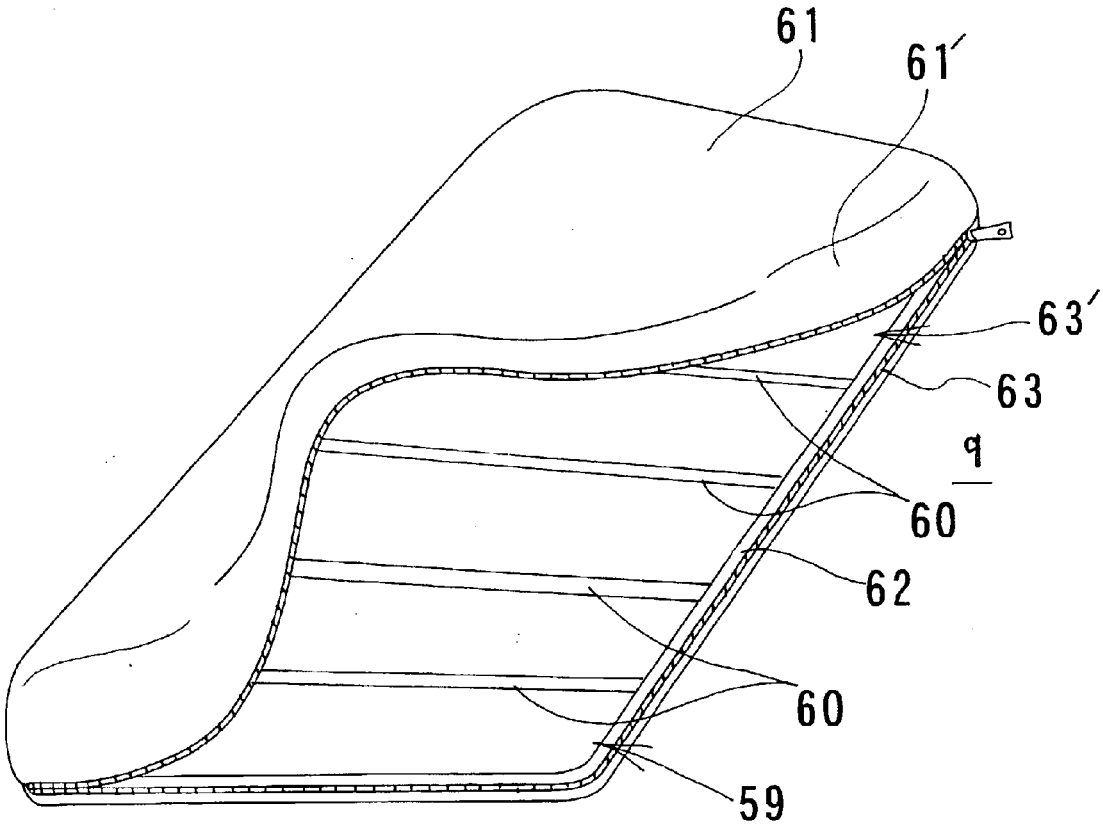
FIG. 22 is a perspective view of a condition where the bottom liner is received in the cover in the sixth embodiment.
Figure 23:
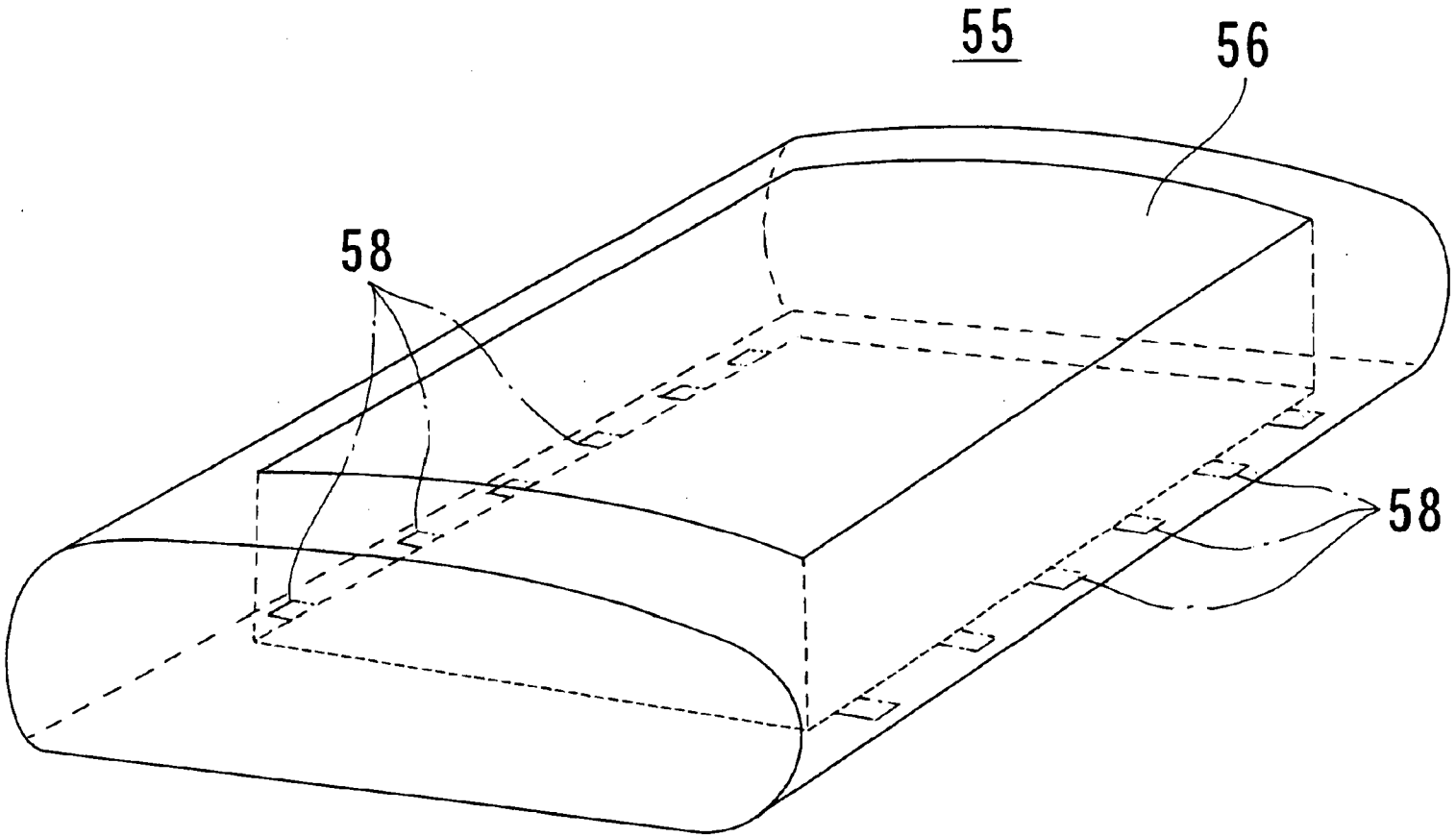
FIG. 23 is a perspective view of a main portion of the cushion body in the sixth embodiment.
Figure 24:
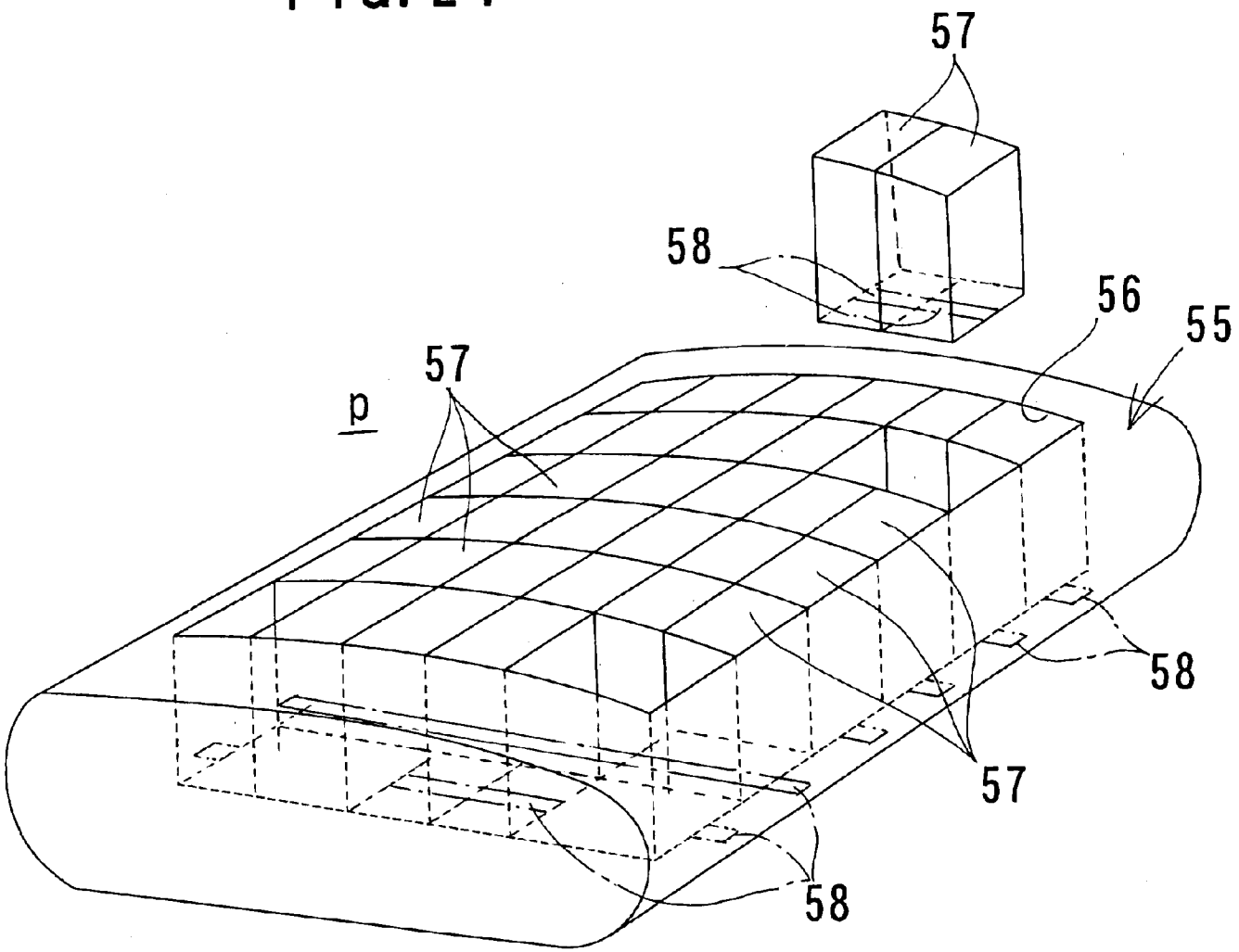
FIG. 24 is a perspective view of the cushion body formed by engaging a cushion member with the main portion.

Next, the fifth embodiment of the ectrimma preventive cushion according to the present invention will be discussed with reference to FIGS. 18 and 19 as one kind of the bedding.

The shown embodiment of the ectrimma preventive cushion n is only differentiated from the forth embodiment of ectrimma preventive cushion m set forth above in that the receiving side fastener straps 52 mounted on the cover k are eliminated and the bottom liner is received on the lower side of the cushion body j. Therefore, like components to those in the fourth embodiment will be identified by like reference numerals and detailed description thereof will be eliminated in order to avoid redundant disclosure and to keep the description simple enough to facilitate a clear understanding of the present invention.

The reference numeral 53 denotes a quadrangular shaped bottom liner formed by wrapping an elastic material, such as sponge or the like, having much smaller thickness in comparison with the main body 40 between the upper and lower flexible material. On the upper surface of the bottom liner 53, the receiving side fastener straps 54 of the Velcro fastener forming a pair with the engaging side fastener straps 48 secured on the lower surfaces of the main body 40 and respective cushion members 42 of the cushion body j are fixed in an X shape pattern corresponding to the X shape pattern of the engaging side fastener straps 48.

The bottom liner 53 is designed to be received within the cover k in a condition where the cushion body j is fitted on the upper surface thereof by engaging the receiving side fastener straps 54 with the engaging side fastener straps 48. By this, the ectrimma preventive cushion n can enhance depression force cushioning function superior to the fourth embodiment which receives only cushion body j.

On the other hand, the bottom liner 53 is placed closing the bottoms of the circular through holes 41. Therefore, when the ectrimma preventive cushion n is used with removing one or some of the cushion members 42 located at positions mating with the affected part of the users body, and if the cushion body j is extremely compressed by the user's weight or other causes, a necessary cushioning or depression force absorbing function can be achieved.

It should be noted that when the upper surface of the bottom liner 53 is formed from a French pile or the like which can directly engage with the engaging side fastener straps 48, it is obviously unnecessary to secure the receiving side fastener straps 54 at the corresponding position to the engaging side fastener straps.

It is clearly possible that the bottom liner 53 may be incorporated in the first embodiment of the ectrimma preventive cushion. Furthermore, by forming the bottom liner into a circular disc or doughnut shape, the bottom liner may also be incorporated in the second and third embodiments of the ectrimma preventive cushions d and g.

Next, the sixth embodiment of a pillow according to the present invention will be discussed with reference to FIGS. 20 to 24, as one kind of bedding.

The reference sign p denotes a cushion body formed by inserting a plurality of cushion members 57 within respective through holes 57 defined in a main body 55.

The main body 55 is formed into a laterally elongated frame form in plan view and has a substantially compressed elliptic shape having a desired thickness as viewed from the lateral side. The main body 55 is formed from the elastic material, such as sponge.

The single quadrangular through hole 56 is opened in a substantial area at the central position of the main body 55 in frame form and extends through the main body 55. A plurality of quadrangular parallelpiped cushion members 57 are neatly and removably inserted in a matrix fashion.

The cushion member 57 is formed from the elastic material, such as sponge or the like similarly to the main body 55. For instance, punched pieces obtained by punching for forming the through hole 56 may be used as the cushion members 57.

On the lower surfaces of respective cushion members 57, engaging side fastener straps 58 of Velcro fasteners are fixed as fastening means, for example. On the other hand, on the lower surface of the main body 55, the engaging side fastener straps 58 are provided in alignment with the engaging side fastener straps 58 of each row of the cushion members arranged in alignment.

The number, size and shape of each through hole 56 and the cushion member 57 may be determined arbitrarily. On the side surface of each cushion member 57, a removal aiding groove similar to those formed in the cushion members 3, 14, 26, 42 in the foregoing first to fifth embodiment, may be cut away so as to facilitate taking out from the through hole by hooking a finger therein.

The reference numeral 59 denotes a quadrangular bottom liner formed by wrapping an elastic material, such as sponge or the like, having a much smaller thickness in comparison with the main body 55 between the upper and lower flexible material. On the upper surface of the bottom liner 59, the receiving side fastener straps 60 of the Velcro fastener forming a pair with the engaging side fastener straps 58 secured on the lower surfaces of the main body 55 and respective cushion members 57 of the cushion body p are fixed in a parallel relationship with each other and at positions corresponding to the engaging side fastener straps 58.

The reference sign q denotes a cover formed of a flexible material, such as cloth, leather or the line, and more preferably stretchable material which is stretchable in an arbitrary direction. The shown embodiment of the pillow p is formed by receiving the cushion body p and the bottom liner 59 in the cover q.

The cover q is formed by placing a substantially quadrangular shaped upper member 61 having a peripheral wall portion 61' and a lower member 62 of a substantially quadrangular shape the same as the upper member 61, in vertical alignment, and by sewing the lower edge of the peripheral wall portion 61' and an outer peripheral edge of the lower member 62 along two edges adjacent across a substantially right angle corner. Along the other two edges, a zipper 63 is fixed as openably closing fastener for forming a taking out opening 63' which can be opened and closed in order to take in and out the cushion body p.

Setting of the cushion body p and the bottom liner 59 in the cover q is performed by engaging the engaging side fastener straps 57 of the cushion body p with the receiving side fastener straps 60 on the cover q and then covering the cushion body with the upper member 61 and the lower member 62 of the cover, and then closing the zipper 63 for fastening the upper member 61 and the lower member 62 to enclose the cushion body q therein.

The shown embodiment of the pillow r constructed as set forth above is featured

The feature of the shown embodiment of the pillow r constructed as set forth above is capable of selective removal of one or more cushion member 57 located at position or positions mating with affected part of the users body to make the through hole 56 hollow. By this, cushion body p does not depress the tumescence on the head portion of the user.

On the other hand, by forming the upper member 61 of the cover from stretchable material, the upper member 61 will not be tensed at the portion corresponding to the hollow of the through hole 56 to penetrate into the hollow of the through hole 56 so as not to excessively depress the affected part.

It should be appreciated that when the French pile or the like is used as a material of the upper surface of the bottom liner 59, the receiving side fastener straps 60 may be eliminated and the engaging side fastener straps 58 can be directly engaged with the upper surface of the bottom liner 59.

Figure 25:
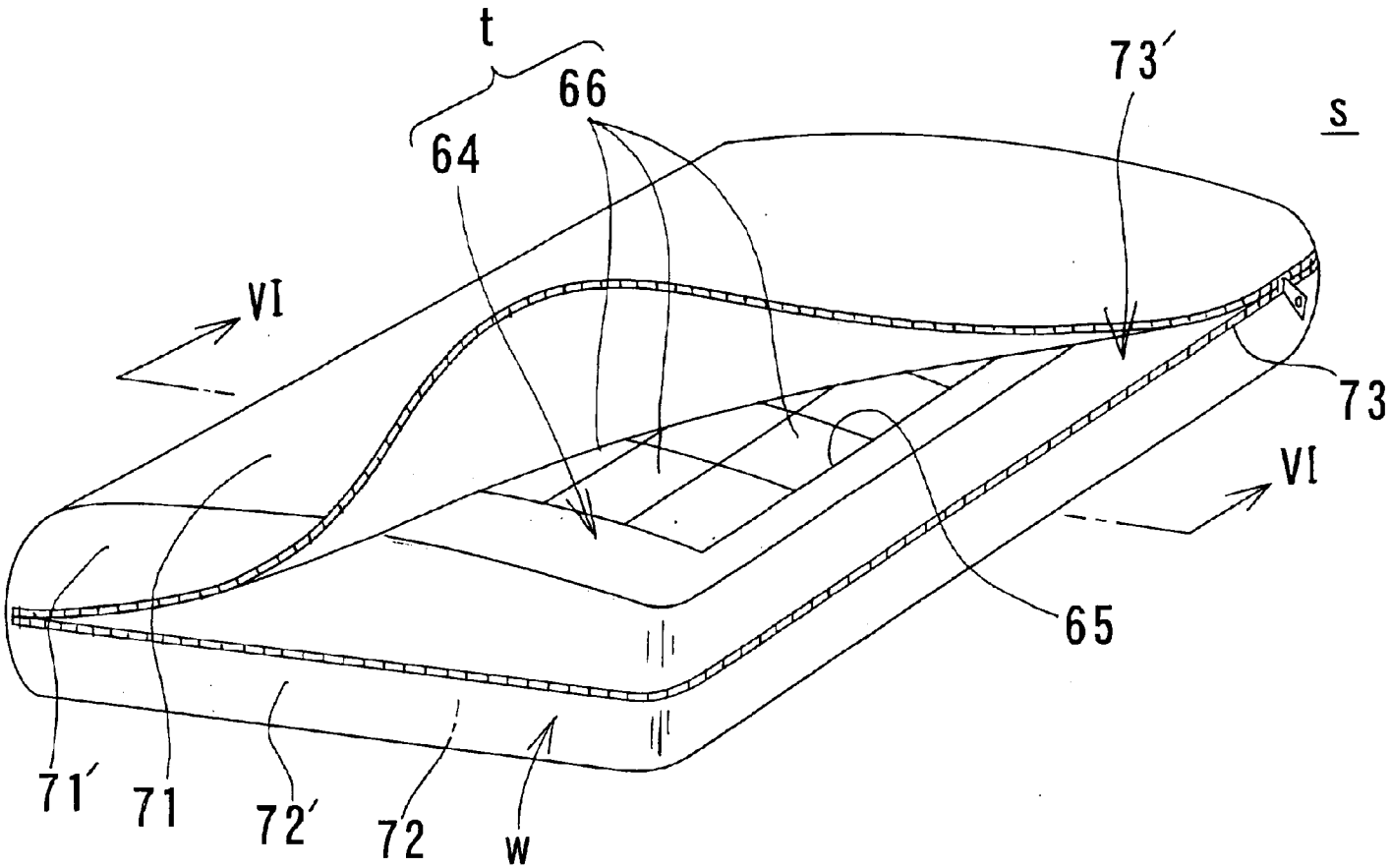
FIG. 25 is a perspective view of the seventh embodiment of an ectrimma preventive cushion according to the present invention.
Figure 26:
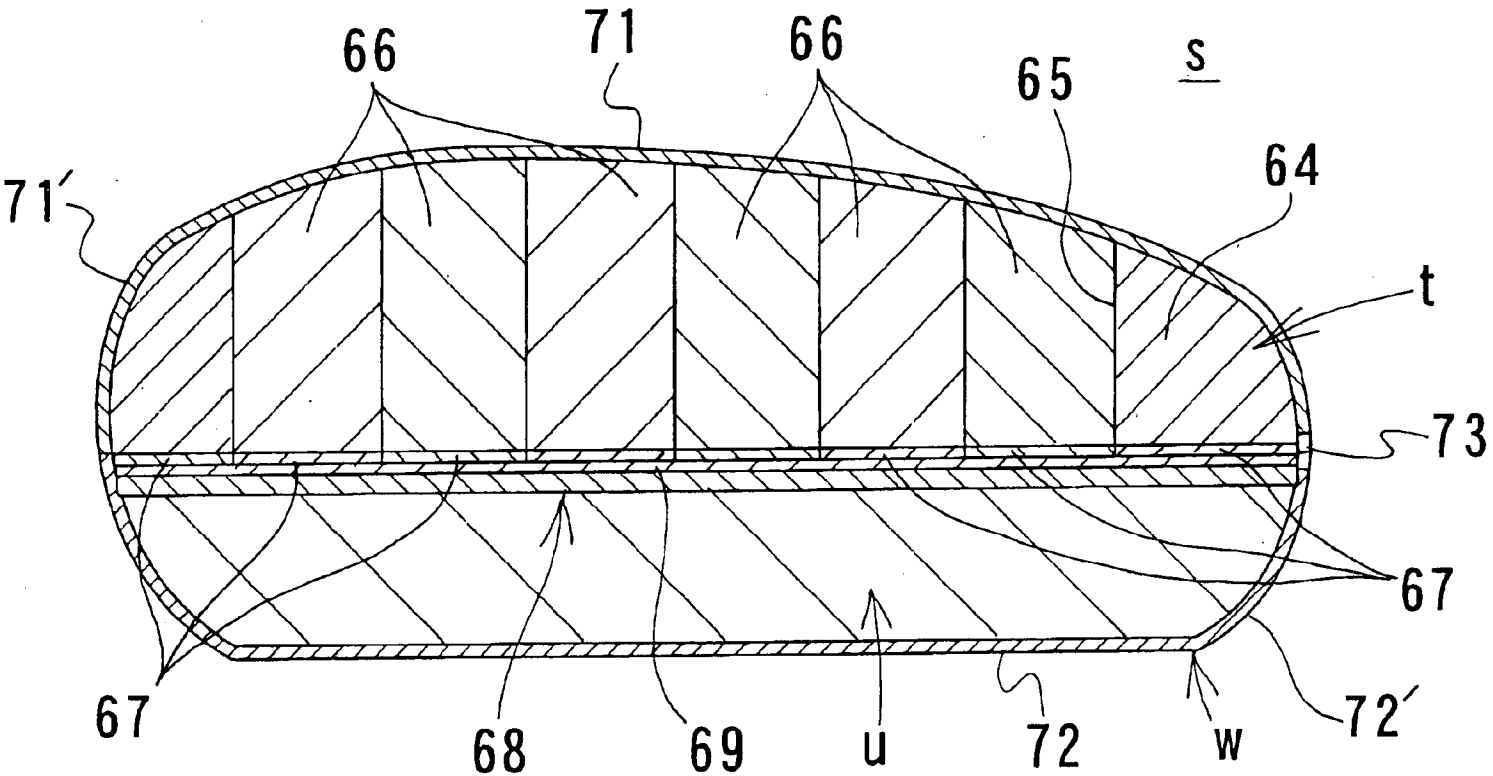
FIG. 26 is a sectional view taken along line VI—VI of FIG. 25.

Next, the seventh embodiment of the pillow according to the present invention will be discussed with reference to FIGS. 25 and 26, as one kind of the bedding.

The shown embodiment of the pillow s is differentiated from the foregoing sixth embodiment of the pillow r in that an auxiliary cushion body is received in lower side of the bottom liner.

The reference sign t denotes a cushion body formed by inserting a plurality of cushion members 66 within a through hole 65 defined in the main body 64.

The main body 64 is laterally elongated frame form in plan view and is a substantially thick semi-elliptic shape with a convex upper surface and a flat lower surface, as viewed from the lateral side. The main body 64 is formed from elastic material, such as sponge or the like.

The single quadrangular through hole 65 is opened in a substantial area at the central position of the main body 64 in frame form and extends through the main body 64. A plurality of quadrangular parallelpiped cushion members 66 are neatly and removably inserted in matrix fashion.

The cushion member 66 is formed from the elastic material, such as sponge or the like similarly to the main body 64. For instance, punched pieces obtained by punching for forming the through hole 65 may be used as the cushion members 66.

On the lower surfaces of respective cushion members 66, engaging side fastener straps 67 of Velcro fasteners are fixed as fastening means, for example. On the other hand, on the lower surface of the main body 64, the engaging side fastener straps 67 are provided in alignment with the engaging side fastener straps 67 of each row of the cushion members 66 arranged in alignment.

The number, size and shape of each through hole 65 and the cushion member 66 may be determined arbitrarily. On the side surface of each cushion member 66, a removal aiding groove similar to those formed in the cushion members 3, 14, 26, 42 in the foregoing first to fifth embodiment, may be cut away so as to facilitate taking out from the through hole by hooking a finger therein.

The reference sign u denotes a thick auxiliary cushion body formed from an elastic material, such as sponge or the like similarly to the cushion body t, and is quadrangular shape in plan view and is a substantially flat semi-elliptic shape as viewed from the side.

The reference numeral 68 denotes a quadrangular bottom liner similar to the bottom liner in the foregoing sixth embodiment. The bottom liner 68 is formed by wrapping an elastic material, such as sponge or the like. On the upper surface of the bottom liner 68, the receiving side fastener straps 69 of the Velcro fastener forming a pair with the engaging side fastener straps 67 secured on the lower surfaces of the main body 64 and respective cushion members 66 of the cushion body t are fixed in parallel relationship with each other and at positions corresponding to the engaging side fastener straps 67.

The bottom liner 68 is fitted on the upper surface of the auxiliary cushion body u, and the cushion body t is fitted thereon with engaging the engaging side fastener straps 67 with the receiving side fastener straps 69.

The reference sign w denotes a cover formed of a flexible material, such as cloth, leather or the line, and more preferably stretchable material which is stretchable in an arbitrary direction. The shown embodiment of the pillow s is formed by receiving the cushion body t, the auxiliary cushion u and the bottom liner 68 in the cover w.

The cover w is formed by placing a substantially quadrangular shaped upper member 71 having a peripheral wall portion 71' and a substantially quadrangular shaped lower member 72 having a peripheral wall portion 72' being the same as the upper member 71, in vertical alignment, and by sewing the lower edge of the peripheral wall portion 71' and the upper edge of the peripheral wall portion 72' along two edges adjacent across a substantially right angle corner. Along the other two edges, a zipper 73 is fixed as an openably closing fastener for forming a taking out opening 73' which can be opened and closed in order to take in and out the cushion body t together with the auxiliary cushion u and the bottom liner 68.

Setting of the cushion body t, the auxiliary cushion body w and the bottom liner 68 in the cover w is performed by engaging the engaging side fastener straps 67 of the cushion body t with the receiving side fastener straps 69 on the cover w, placing a sub-assembly of the cushion body t and the bottom liner 68 on the auxiliary cushion body u, and then covering the cushion body t, the auxiliary cushion body u and the bottom liner 68 with the upper member 71 and the lower member 72 of the cover w, and then closing the zipper 73 for fastening the upper member 71 and the lower member 72 to enclose the cushion body t, the auxiliary cushion body u and the bottom liner 68 therein.

Since the pillow s constructed as set forth above receives the auxiliary cushion body u on lower side of the bottom liner 68, cushioning function can be enhanced superior to the sixth embodiment of the pillow.

The pillow s is normally used with placing the cushion body t on an upper side. Then, by removing cushion members 66 located at the affected part of the user's body, depression force at the affected part can be eliminated. On the other hand, the pillow may also be used with placing the auxiliary cushion body u on an upper side and placing the cushion body t on a lower side.

It should be appreciated that when the French pile or the like is used as a material of the upper surface of the bottom liner 68, the receiving side fastener straps 69 may be eliminated and the engaging side fastener straps 67 can be directly engaged with the upper surface of the bottom liner 68.

In respective embodiment set forth above, it is preferable to provide significant unevenness on the upper surface of the cushion body a, a', e, h, j, p, t and the lower surface of the auxiliary cushion body u. By such unevenness, oppressive feeling of the user can be reduced. Also, heat and humidity can be ventilated.

It should be noted that, in the embodiments other than the fourth and fifth embodiments, the cushion body is formed from the elastic member, such as sponge or the like. However, the laminated elastic material employed in the fourth and fifth embodiments may be employed even in the other embodiments.

Also, the cushion members 3, 14, 26, 42, 57, 66 are not necessarily formed from the elastic material but can be formed from any appropriate material having higher hardness than the elastic material of the main body 1, 12, 23, 40, 55 and 64.

Figure 27A:
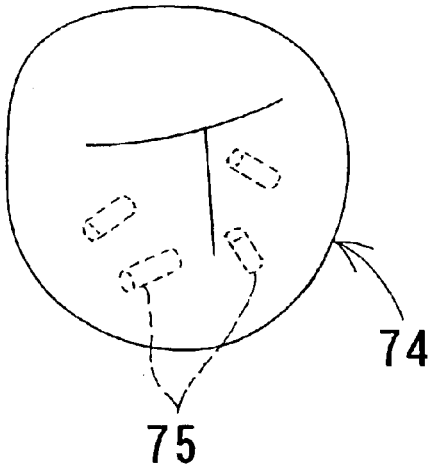
FIG. 27A is a perspective view of a modification of the cushion member.
Figure 27B:
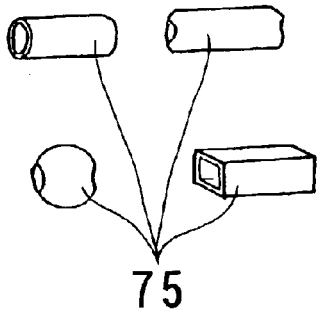
FIG. 27B is an enlarged perspective view of fillers filled in the cushion member.

For example, a cushion member 74 shown in FIG. 27A is formed by filling plastic fillers 75 of pipe form or hollow ball form and of the size of several millimeters in a bag member to be inserted into the through holes 2, 13, 25, 41, 56, 65. This cushion member 74 permits free movement of the fillers 75 for deformation. However, each individual filler 75 causes little deformation.

Accordingly, when the user's body excessively sinks as using the first to fifth embodiments of the ectrimma preventive cushions c, d, g, m, n or when the user's head excessively sinks as using the sixth and seventh embodiments of the pillows r, s, the cushion members 74 may be inserted into the through holes 2, 13, 25, 41, 56, 65 for preventing excessive sinking.

As can be clear from the above, the bedding according to the present invention is constructed by receiving the cushion body in the cover; it can be normally used as mat, seat cushion or pillow upon seating on various chairs or lying on the floor or bed.

Also, since the bedding according to the present invention is constructed with removably inserting a cushion member or members in one or more through holes defined through the main body, it becomes possible to remove the cushion member located at the position corresponding to the affected part of the user's body so that the cushion body does not contact with the affected part.

The bedding according to the present invention is effective in prevention of occurrence or deterioration of ectrimma, protection of the affected part, such as a tumor or the like, and so on.

On the other hand, removal of the cushion member can be facilitated as can be done through the take out opening.

In addition, the bedding according to the present invention has the cushion member formed with the removal aiding groove on one side surface. Therefore, upon removing, the cushion member can be easily taken out by hooking a finger on the removal aiding groove.

Furthermore, in the bedding according to the present invention, since the fastening means is provided on the lower surface of the cushion member, the cushion member can be secured in the through hole without causing displacement.

Also, in the bedding according to the present invention, since the cushion member and/or the main body are formed from the laminated elastic material prepared by laminating a plurality of elastic materials, it becomes possible to prepare the cushion member and/or the main body with the necessary hardness by appropriately determining the hardness and thicknesses of the respective layers. Furthermore, by forming a large number of fine conduits in an arbitrarily selected layer, flexibility can be enhanced.

In the bedding according to the present invention, since the cushion member and/or main body is formed with a significant unevenness on the upper surface, oppressive feeling of the user can be reduced and heat and humidity can be ventilated.

In the bedding according to the present invention, since the cover is formed from stretchable material which can be stretched in any direction, the affected part of the user may not be depressed.

Furthermore, in the bedding according to the present invention, since the bottom liner formed by enclosing thin elastic material between the upper and lower surfaces of the flexible member is placed below the cushion body, cushioning function can be enhanced. Also, since the bottom liner is placed with closing the lower side of the through holes, even if the cushion body is extremely compressed by body weight of the user or other cause as used with removing the cushion member or members at the positions where removal is required, necessary cushioning function can be maintained.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. A bedding comprising:

a cushion body;

a cover enclosing said cushion body therein; and a bottom liner formed by enclosing a thin elastic material between upper and lower surfaces of a flexible material and placed below said cushion body, said cushion body formed of an elastic material and defining at least one through hole for removably receiving therein at least one cushion member, and said cover defining take out opening which can be opened and closed.

2. A bedding comprising:

a cushion body;

a cover enclosing said cushion body therein; and a bottom liner formed by enclosing a thin elastic material between upper and lower surfaces of a flexible material and placed below said cushion body, said cushion body formed of an elastic material and including a thick quadrangular main body defining at least one through hole, and at least one cushion member removably received within said through hole, and said cover being formed by placing a substantially quadrangular shaped upper member having peripheral wall portion and a lower member of substantially quadrangular shape the same as the upper member, in vertical alignment, by sewing the lower edge of said peripheral wall portion and an outer peripheral edge of the lower member along two edges adjacent across substantially right angle corner, by providing on the other two edges, an openably closing fastener for forming a taking out opening which can be opened and closed in order to take in and out the cushion body, and providing at least one mounting strap on the outer peripheral edge of said lower member.

3. A bedding as set forth in any one of claims 1 and 2, wherein said cushion body is formed from a laminated elastic material consisted of an upper layer, an intermediate layer and a lower layer, and said intermediate layer has the highest hardness among constituent layers.

4. A bedding as set forth in any one of claims 1 and 2, wherein said cover is formed from a stretchable material which is stretchable in arbitrary direction.

* * * * *